US008182251B2

(12) United States Patent
Shiotani et al.

(10) Patent No.: US 8,182,251 B2
(45) Date of Patent: May 22, 2012

(54) EXPANDER-COMPRESSOR UNIT

(75) Inventors: Yu Shiotani, Osaka (JP); Takeshi Ogata, Osaka (JP); Shingo Oyagi, Osaka (JP); Masanobu Wada, Osaka (JP); Yasufumi Takahashi, Osaka (JP)

(73) Assignee: Panasonic Corporation, Osaka (JP)

( * ) Notice: Subject to any disclaimer, the term of this patent is extended or adjusted under 35 U.S.C. 154(b) by 184 days.

(21) Appl. No.: 12/743,696

(22) PCT Filed: Oct. 23, 2008

(86) PCT No.: PCT/JP2008/003000

§ 371 (c)(1),
(2), (4) Date: May 19, 2010

(87) PCT Pub. No.: WO2009/066413

PCT Pub. Date: May 28, 2009

(65) Prior Publication Data

US 2010/0263404 A1 Oct. 21, 2010

(30) Foreign Application Priority Data

Nov. 21, 2007 (JP) ..... 2007-301434
Nov. 21, 2007 (JP) ..... 2007-301436

(51) Int. Cl.

| | |
|---|---|
| ***F01C 21/04*** | (2006.01) |
| ***F01C 21/06*** | (2006.01) |
| ***F03C 2/00*** | (2006.01) |
| ***F03C 4/00*** | (2006.01) |
| ***F04C 2/00*** | (2006.01) |
| ***F04C 15/00*** | (2006.01) |
| ***F04C 27/02*** | (2006.01) |
| ***F04C 29/02*** | (2006.01) |
| ***F04C 29/04*** | (2006.01) |

(52) U.S. Cl. ..... 418/94; 417/373; 417/410.5

(58) Field of Classification Search ..... 417/410.5, 417/373, 374; 418/3, 55.6, 83, 85, 88, 91, 418/92, 94; 184/6.11, 6.21, 6.22; 62/402, 62/403, 468

See application file for complete search history.

(56) References Cited

U.S. PATENT DOCUMENTS 3,848,702 A * 11/1974 Bergman ..... 184/6.3
4,846,640 A * 7/1989 Nishida et al. ..... 418/55.6

(Continued)

FOREIGN PATENT DOCUMENTS

EP 1 918 510 A1 5/2008

(Continued)

*Primary Examiner* — Devon Kramer
*Assistant Examiner* — Christopher Maxey
(74) *Attorney, Agent, or Firm* — Hamre, Schumann, Mueller & Larson, P.C.

(57) ABSTRACT

An expander-compressor unit (200A) includes a closed casing (1), a compression mechanism (2), an expansion mechanism (3), a shaft (5), and an oil pump (6). The shaft (5) couples the compression mechanism (2) to the expansion mechanism (3) so that power recovered by the expansion mechanism (3) is transferred to the compression mechanism (2). The oil pump (6) is disposed between the compression mechanism (2) and the expansion mechanism (3), and supplies an oil held in an oil reservoir (25) to the compression mechanism (2). An oil supply passage (29) is formed in the shaft (5) so that the oil discharged from the oil pump (6) can be supplied to the compression mechanism (2). A lower end (29*e*) of the oil supply passage (29) is located below an inlet (29*p*) of the oil supply passage (29) formed in an outer circumferential surface of the shaft (5).

15 Claims, 16 Drawing Sheets

U.S. PATENT DOCUMENTS

| | | | | | |
|---|---|---|---|---|---|
| 4,865,530 | A | * | 9/1989 | Nishida et al. | 418/55.6 |
| 5,214,932 | A | * | 6/1993 | Abdelmalek | 62/238.4 |
| 5,263,822 | A | * | 11/1993 | Fujio | 418/55.4 |
| 5,358,392 | A | * | 10/1994 | Ukai | 418/55.6 |
| 5,520,526 | A | * | 5/1996 | Fujio | 418/55.4 |
| 5,616,019 | A | | 4/1997 | Hattori et al. | |
| 5,660,539 | A | * | 8/1997 | Matsunaga et al. | 418/55.6 |
| 5,775,883 | A | * | 7/1998 | Hattori et al. | 417/310 |
| 6,098,753 | A | * | 8/2000 | Lamarre et al. | 184/6.11 |
| 6,116,877 | A | | 9/2000 | Takeuchi et al. | |
| 7,628,592 | B2 | * | 12/2009 | Okamoto et al. | 418/3 |
| 7,717,688 | B2 | * | 5/2010 | Yoo et al. | 418/88 |
| 7,771,180 | B2 | * | 8/2010 | Cho et al. | 418/55.6 |
| 7,896,627 | B2 | * | 3/2011 | Okamoto et al. | 418/13 |
| 8,033,135 | B2 | * | 10/2011 | Okaichi et al. | 62/468 |
| 8,087,260 | B2 | * | 1/2012 | Ogata et al. | 62/401 |
| 2006/0204378 | A1 | * | 9/2006 | Anderson | 417/410.5 |
| 2008/0232992 | A1 | | 9/2008 | Okamoto et al. | |
| 2009/0007590 | A1 | * | 1/2009 | Sakitani et al. | 62/513 |
| 2009/0139262 | A1 | | 6/2009 | Takahashi et al. | |
| 2009/0282845 | A1 | * | 11/2009 | Hasegawa et al. | 62/87 |
| 2010/0003147 | A1 | | 1/2010 | Takahashi et al. | |
| 2010/0089092 | A1 | * | 4/2010 | Hasegawa et al. | 62/498 |
| 2010/0107680 | A1 | * | 5/2010 | Ogata et al. | 62/468 |
| 2010/0132398 | A1 | * | 6/2010 | Takahashi et al. | 62/468 |
| 2010/0162750 | A1 | * | 7/2010 | Okaichi et al. | 62/498 |
| 2010/0186439 | A1 | * | 7/2010 | Ogata et al. | 62/402 |
| 2010/0202909 | A1 | * | 8/2010 | Shiotani et al. | 418/3 |
| 2010/0254844 | A1 | | 10/2010 | Oyagi et al. | |
| 2010/0269536 | A1 | | 10/2010 | Wada et al. | |
| 2010/0275638 | A1 | * | 11/2010 | Hasegawa et al. | 62/402 |
| 2011/0138831 | A1 | * | 6/2011 | Ogata et al. | 62/193 |
| 2011/0302954 | A1 | * | 12/2011 | Okaichi et al. | 62/468 |

FOREIGN PATENT DOCUMENTS

| | | | | |
|---|---|---|---|---|
| EP | 1 965 022 | A1 | | 9/2008 |
| EP | 2 020 483 | A1 | | 2/2009 |
| JP | 8-028461 | A | | 1/1996 |
| JP | 8-082296 | A | | 3/1996 |
| JP | 08086289 | A | * | 4/1996 |
| JP | 9-126171 | A | | 5/1997 |
| JP | 10266980 | A | * | 10/1998 |
| JP | 2003-139059 | A | | 5/2003 |
| JP | 2005-299632 | A | | 10/2005 |
| JP | 2006132377 | A | * | 5/2006 |
| JP | 2006-283590 | A | | 10/2006 |
| JP | 2007315227 | A | * | 12/2007 |
| JP | 2008-008165 | A | | 1/2008 |
| JP | 2008-215212 | A | | 9/2008 |
| JP | 2008-240550 | A | | 10/2008 |
| WO | WO 2007/000854 | A1 | | 1/2007 |
| WO | WO 2007/132649 | A1 | | 11/2007 |
| WO | WO 2008/087795 | A1 | | 7/2008 |

* cited by examiner

EXPANDER-COMPRESSOR UNIT

TECHNICAL FIELD

The present invention relates to an expander-compressor unit including a compression mechanism for compressing a fluid and an expansion mechanism for expanding the fluid.

BACKGROUND ART

As an example of fluid machines having an expansion mechanism and a compression mechanism, an expander-compressor unit conventionally has been known. FIG. 15 is a vertical cross-sectional view of an expander-compressor unit described in JP 2005-299632 A.

An expander-compressor unit 103 includes a closed casing 120, a compression mechanism 121, a motor 122, and an expansion mechanism 123. A shaft 124 couples the motor 122, the compression mechanism 121, and the expansion mechanism 123. The expansion mechanism 123 recovers power from a working fluid (such as a refrigerant) expanding, and provides the recovered power to the shaft 124. Thereby, the power consumption of the motor 122 for driving the compression mechanism 121 is reduced, and the coefficient of performance of a system using the expander-compressor unit 103 is increased.

The closed casing 120 has a bottom portion 125 utilized as an oil reservoir. An oil pump 126 is provided at a lower end of the shaft 124 in order to pump up an oil held in the bottom portion 125 to an upper part of the closed casing 120. The oil pumped up by the oil pump 126 is supplied to the compression mechanism 121 and the expansion mechanism 123 through an oil supply passage 127 formed in the shaft 124. Thereby, lubrication and sealing are ensured in sliding parts of the compression mechanism 121 and those of the expansion mechanism 123.

An oil return passage 128 is provided at an upper part of the expansion mechanism 123. One end of the oil return passage 128 is connected to the oil supply passage 127 formed in the shaft 124, and the other end thereof opens downwardly below the expansion mechanism 123. Generally, the oil is supplied excessively for ensuring the reliability of the expansion mechanism 123. The excess oil is discharged downwardly below the expansion mechanism 123 through the oil return passage 128.

Usually, the amount of the oil contained in the working fluid is different between the compression mechanism 121 and the expansion mechanism 123. Thus, in the case where the compression mechanism 121 and the expansion mechanism 123 are accommodated in separate closed casings, a means for adjusting the amount of the oil in the two closed casings is essential in order to prevent the amount of the oil from being excessive or deficient. In contrast, the expander-compressor unit 103 shown in FIG. 11 intrinsically is free from the problem of the excess or deficient oil amount because the compression mechanism 121 and the expansion mechanism 123 are accommodated in the same closed casing 120.

In the expander-compressor unit 103, the oil pumped up from the bottom portion 125 is heated by the compression mechanism 121 because the oil passes through the compression mechanism 121 having a high temperature. The oil heated by the compression mechanism 121 is heated further by the motor 122 and reaches the expansion mechanism 123. The oil that has reached the expansion mechanism 123 is cooled by the expansion mechanism 123 having a low temperature, and thereafter is discharged downwardly below the expansion mechanism 123 through the oil return passage 128. The oil discharged from the expansion mechanism 123 is heated when passing along a side face of the motor 122. The oil is heated further also when passing along a side face of the compression mechanism 121, and returns to the bottom portion 125 of the closed casing 120.

As described above, the oil circulates between the compression mechanism and the expansion mechanism so that the heat is transferred from the compression mechanism to the expansion mechanism via the oil. This heat transfer lowers the temperature of the working fluid discharged from the compression mechanism and raises the temperature of the working fluid discharged from the expansion mechanism, hindering the increase in the coefficient of performance of the system using the expander-compressor unit.

DISCLOSURE OF INVENTION

The present invention has been accomplished in view of the foregoing. The present invention is intended to suppress the heat transfer from a compression mechanism to an expansion mechanism in an expander-compressor unit.

In order to achieve the above-mentioned object, the present inventors disclose, in International Application PCT/JP2007/058871 (filing date Apr. 24, 2007, priority date May 17, 2006) preceding the present application, an expander-compressor unit including: a closed casing having a bottom portion utilized as an oil reservoir; a compression mechanism disposed in the closed casing so as to be located above or below an oil level of an oil held in the oil reservoir; an expansion mechanism disposed in the closed casing so that a positional relationship of the expansion mechanism with respect to the oil level is vertically opposite to that of the compression mechanism; a shaft coupling the compression mechanism and the expansion mechanism; and an oil pump disposed between the compression mechanism and the expansion mechanism and configured to supply the oil filling a surrounding space of the compression mechanism or the expansion mechanism to the compression mechanism or the expansion mechanism located above the oil level.

In the above-mentioned expander-compressor unit, the vertical positional relationship between the compression mechanism and the expansion mechanism is not limited. However, when the compression mechanism is disposed above the oil level and the expansion mechanism is disposed below the oil level, higher effect of preventing the heat transfer via the oil can be obtained. Also, it has been found that adding the following improvements can enhance further the effect of preventing the heat transfer.

More specifically, the present invention provides an expander-compressor unit including:

a closed casing having a bottom portion utilized as an oil reservoir, and an internal space filled with a working fluid that has been compressed and has a high pressure;

a compression mechanism disposed at an upper position in the closed casing, the compression mechanism being configured to compress the working fluid and discharge the working fluid to the internal space of the closed casing;

an expansion mechanism disposed at a lower position in the closed casing so that a surrounding space thereof is filled with an oil held in the oil reservoir, the expansion mechanism being configured to recover power from the working fluid expanding;

a shaft coupling the compression mechanism to the expansion mechanism so that the power recovered by the expansion mechanism is transferred to the compression mechanism;

an oil pump for supplying the oil held in the oil reservoir to the compression mechanism, the oil pump being disposed between the compression mechanism and the expansion mechanism in an axial direction of the shaft; and an oil supply passage formed in the shaft so that the oil discharged from the oil pump can be supplied to the compression mechanism, the oil supply passage having a lower end located below an inlet formed in an outer circumferential surface of the shaft.

As the expander-compressor unit of the present invention, a so-called high pressure shell type unit in which a closed casing is filled with a high temperature, high pressure working fluid is employed. The compression mechanism that has a high temperature during operation is disposed at the upper position in the closed casing. The expansion mechanism that has a low temperature during operation is disposed at the lower position in the closed casing. The oil for lubricating the compression mechanism and the expansion mechanism is held in the bottom portion of the closed casing. The oil pump is disposed between the compression mechanism and the expansion mechanism, and the oil is supplied to the compression mechanism from the oil pump through the oil supply passage formed in the shaft. The oil drawn into the oil pump is supplied to the upper-located compression mechanism without passing through the lower-located expansion mechanism. In other words, it is possible to avoid having the expansion mechanism located on a circulation passage for the oil lubricating the compression mechanism. Thereby, the heat transfer from the compression mechanism to the expansion mechanism via the oil is suppressed.

Furthermore, in the present invention, the lower end of the oil supply passage formed in the shaft is located below the inlet of the oil supply passage. Accordingly, the oil stays in a portion of the oil supply passage below the inlet. This makes it unlikely for the heat to be transferred to the expansion mechanism via the shaft serving as a heat conductive passage because the oil has a lower heat conductivity than that of the material (usually metal) constituting the shaft.

BEST MODE FOR CARRYING OUT THE INVENTION

Hereinbelow, embodiments of the present invention will be described with reference to the accompanying drawings.

Embodiment 1

Figure 1:
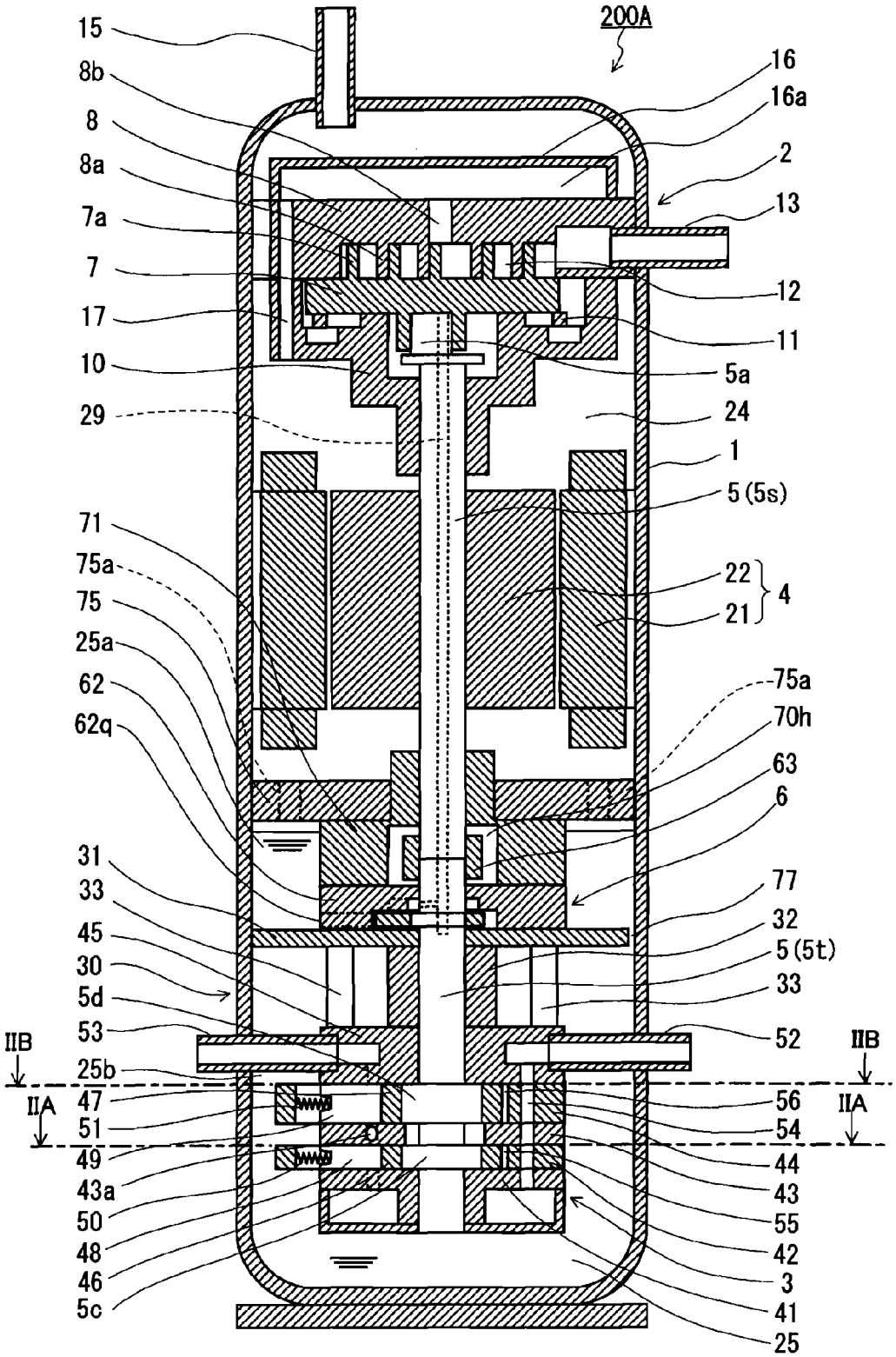
FIG. 1 is a vertical cross-sectional view of an expander-compressor unit according to Embodiment 1 of the present invention.
Figure 2A:
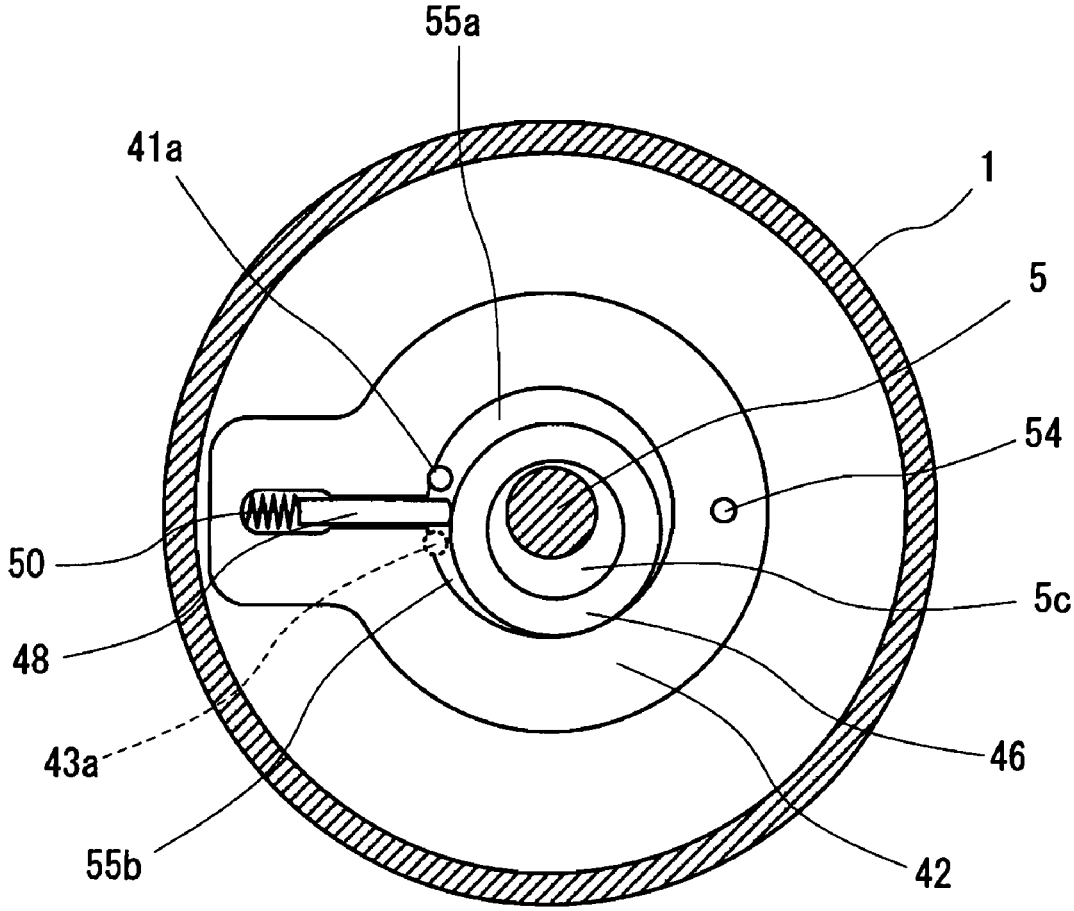
FIG. 2A is a transverse cross-sectional view of the expander-compressor unit shown in FIG. 1 taken along the line IIA-IIA.
Figure 2B:
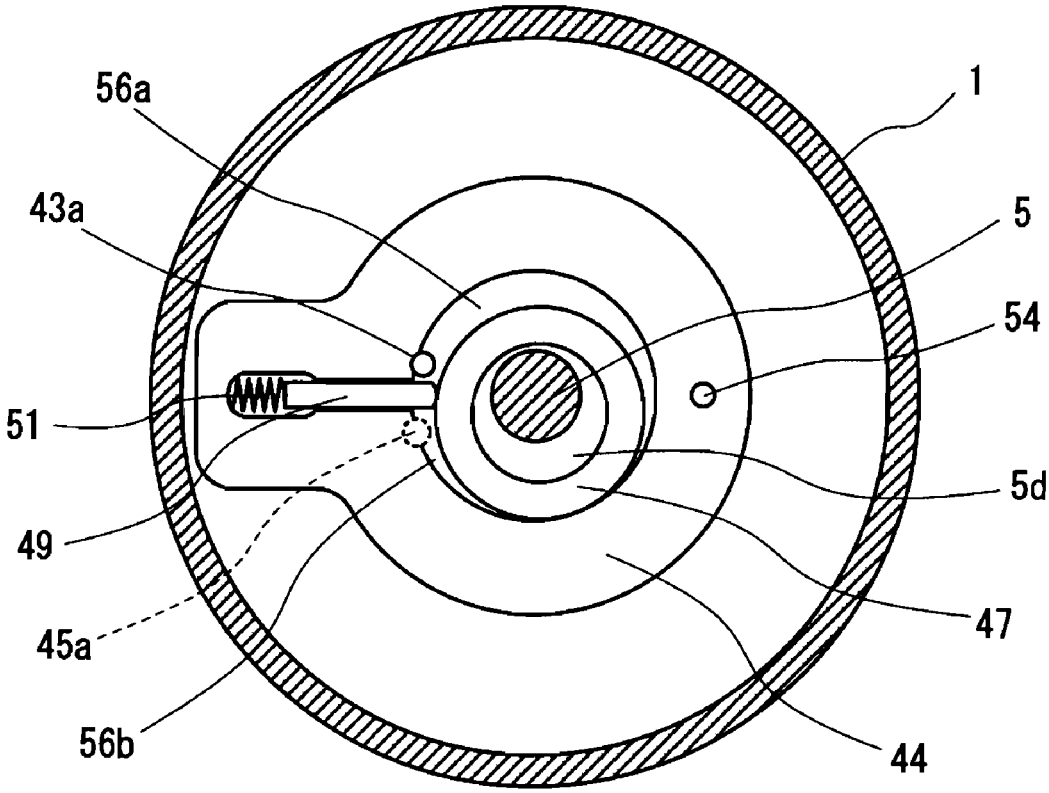
FIG. 2B is a transverse cross-sectional view taken along the line IIB-IIB in the same manner.
Figure 3:
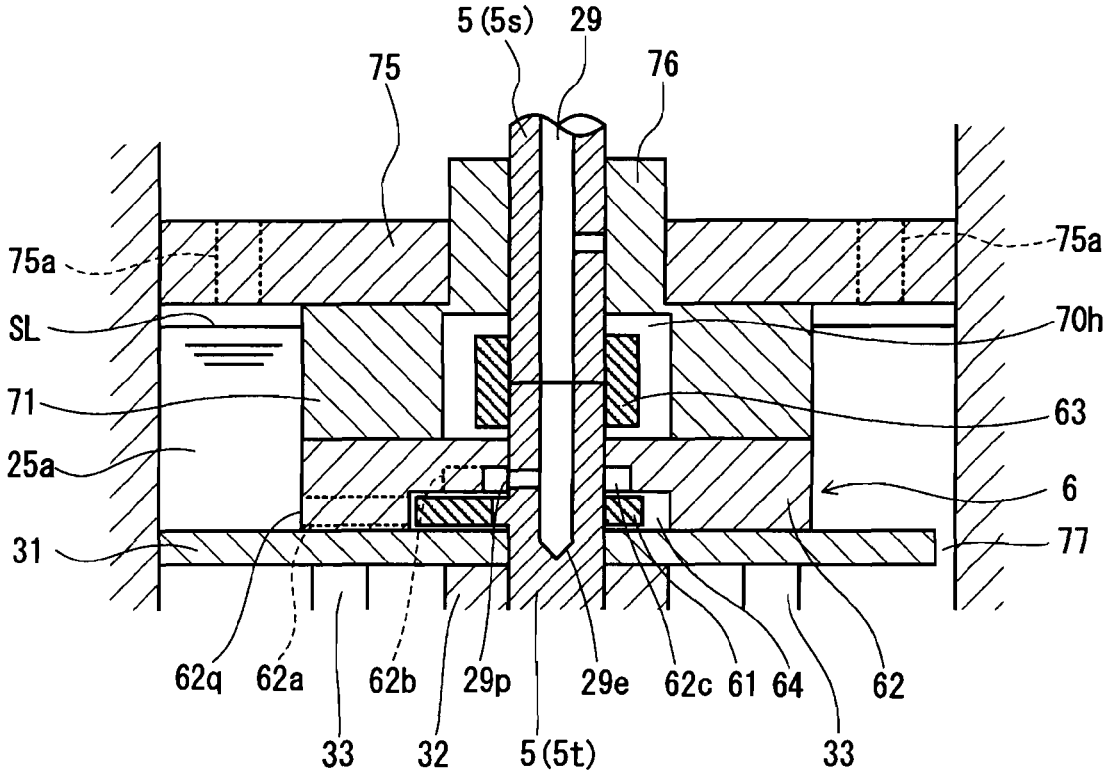
FIG. 3 is a partially enlarged view of FIG. 1.

FIG. 1 is a vertical cross-sectional view of an expander-compressor unit according to Embodiment 1 of the present invention. FIG. 2A is a transverse cross-sectional view of the expander-compressor unit shown in FIG. 1 taken along the line IIA-IIA. FIG. 2B is a transverse cross-sectional view of the expander-compressor unit shown in FIG. 1 taken along the line IIB-IIB. FIG. 3 is a partially enlarged view of FIG. 1.

As shown in FIG. 1, an expander-compressor unit 200A according to the Embodiment 1 includes a closed casing 1, a scroll-type compression mechanism 2 disposed at an upper portion in the closed casing 1, a two-stage rotary-type expansion mechanism 3 disposed at a lower portion in the closed casing 1, a motor 4 disposed between the compression mechanism 2 and the expansion mechanism 3, a shaft 5 coupling the compression mechanism 2, the expansion mechanism 3, and the motor 4, an oil pump 6 disposed between the motor 4 and the expansion mechanism 3, and a heat insulating structure 30 disposed between the expansion mechanism 3 and the oil pump 6. The motor 4 drives the shaft 5 so as to operate the compression mechanism 2. The expansion mechanism 3 recovers power from a working fluid expanding and applies it to the shaft 5 to assist the driving of the shaft 5 by the motor 4. The working fluid is, for example, a refrigerant such as carbon dioxide and hydrofluorocarbon.

In this description, an axial direction of the shaft 5 is defined as a vertical direction, a side on which the compression mechanism 2 is disposed is defined as an upper side, and a side on which the expansion mechanism 3 is disposed is defined as a lower side. Furthermore, although the scroll-type compression mechanism 2 and the rotary-type expansion mechanism 3 are employed in the present embodiment, the types of the compression mechanism 2 and the expansion mechanism 3 are not limited to these. They may be another type of positive displacement mechanism. For example, both of the compression mechanism and the expansion mechanism may be the rotary-type or the scroll-type.

As shown in FIG. 1, the closed casing 1 has a bottom portion utilized as an oil reservoir 25, and an internal space 24 above the oil reservoir is filled with the working fluid. An oil is used for ensuring lubrication and sealing of sliding parts of the compression mechanism 2 and the expansion mechanism 3. The amount of the oil held in the oil reservoir 25 is adjusted so that an oil level SL (see FIG. 3) is present above an oil suction port 62*q* of the oil pump 6 and below the motor 4 in a state where the closed casing 1 is placed upright, i.e., in a state where the posture of the closed casing 1 is determined so that the axial direction of the shaft 5 is parallel to the vertical direction. In other words, the locations of the oil pump 6 and the motor 4, and the shape and size of the closed casing 1 for accommodating these elements are determined so that the oil level of the oil is present between the oil suction port 62*q* of the oil pump 6 and the motor 4.

The oil reservoir 25 includes an upper tank 25*a* in which the oil suction port 62*q* of the oil pump 6 is located and a lower tank 25*b* in which the expansion mechanism 3 is located. The upper tank 25*a* and the lower tank 25*b* are separated from each other by a member (specifically, a partition plate 31 to be described later) composing the heat insulating structure 30. A surrounding space of the oil pump 6 is filled with the oil held in the upper tank 25*a*, and a surrounding space of the expansion mechanism 3 is filled with the oil held in the lower tank 25*b*. The oil held in the upper tank 25*a* is used mainly for the compression mechanism 2, and the oil held in the lower tank 25*b* is used mainly for the expansion mechanism 3.

The oil pump 6 is disposed between the compression mechanism 2 and the expansion mechanism 3 in the axial direction of the shaft 5 so that the oil level of the oil held in the upper tank 25*a* is present above the oil suction port 62*q*. A support frame 75 is disposed between the motor 4 and the oil pump 6. The support frame 75 is fixed to the closed casing 1. The oil pump 6, the heat insulating structure 30, and the expansion mechanism 3 are fixed to the closed casing 1 via the support frame 75. A plurality of through holes 75*a* are formed in an outer peripheral portion of the support frame 75 so that the oil that lubricated the compression mechanism 2 and the oil that has been separated from the working fluid discharged to the internal space 24 of the closed casing 1 can return to the upper tank 25*a*. The number of the through hole 75*a* may be one.

The oil pump 6 draws the oil held in the upper tank 25*a*, and supplies the oil to the sliding parts of the compression mechanism 2. The oil returning to the upper tank 25*a* through the through holes 75*a* of the support frame 75 after lubricating the compression mechanism 2 has a relatively high temperature because it has been heated by the compression mechanism 2 and the motor 4. The oil that has returned to the upper tank 25*a* is drawn into the oil pump 6 again. On the other hand, the oil held in the lower tank 25*b* is supplied to the sliding parts of the expansion mechanism 3. The oil that lubricated the sliding parts of the expansion mechanism 3 is returned directly to the lower tank 25*b*. The oil held in the lower tank 25*b* has a relatively low temperature because it has been cooled by the expansion mechanism 3. By disposing the oil pump 6 between the compression mechanism 2 and the expansion mechanism 3 and supplying the oil to the compression mechanism 2 by using the oil pump 6, it is possible to keep a circulation passage for the high temperature oil lubricating the compression mechanism 2 away from the expansion mechanism 3. In other words, the circulation passage for the high temperature oil lubricating the compression mechanism 2 can be separated from a circulation passage for the low temperature oil lubricating the expansion mechanism 3. Thereby, the heat transfer from the compression mechanism 2 to the expansion mechanism 3 via the oil is suppressed.

Although the effect of suppressing the heat transfer can be obtained with only the oil pump 6 disposed between the compression mechanism 2 and expansion mechanism 3, the addition of the heat insulating structure 30 can enhance this effect significantly.

When the expander-compressor unit 200A is being operated, the oil held in the oil reservoir 25 has a relatively high temperature in the upper tank 25*a* and has a relatively low temperature in a surrounding space of the expansion mechanism 3 located in the lower tank 25*b*. The heat insulating structure 30 restricts a flow of the oil between the upper tank 25*a* and the lower tank 25*b* so as to maintain the state in which the high temperature oil is held in the upper tank 25*a* and the low temperature oil is held in the lower tank 25*b*. Furthermore, the presence of the heat insulating structure 30 increases a distance between the oil pump 6 and the expansion mechanism 3 in the axial direction. This also makes it possible to reduce the amount of the heat transfer from the oil filling the surrounding space of the oil pump 6 to the expansion mechanism 3. The flow of the oil between the upper tank 25*a* and the lower tank 25*b* is restricted but not prohibited by the heat insulating structure 30. The flow of the oil from the upper tank 25*a* to the lower tank 25*b* and vice versa can occur so as to balance the oil amount.

Hereinafter, each component will be described in further detail.

<<Compression Mechanism 2>>

The scroll-type compression mechanism 2 includes an orbiting scroll 7, a stationary scroll 8, an Oldham ring 11, a bearing member 10, a muffler 16, a suction pipe 13, and a discharge pipe 15. The orbiting scroll 7 is fitted with an eccentric pivot 5*a* of the shaft 5, and the self-rotation of the orbiting scroll 7 is restrained by the Oldham ring 11. The orbiting scroll 7, with a spiral shaped lap 7*a* thereof meshing with a lap 8*a* of the stationary scroll 8, scrolls in association with the rotation of the shaft 5. A crescent-shaped working chamber 12 formed between the laps 7*a* and 8*a* moves from outside to inside so as to reduce its volumetric capacity, and thereby the working fluid drawn from the suction pipe 13 is compressed. The compressed working fluid passes through a discharge port 8*b* formed at a center of the stationary scroll 8, an internal space 16*a* of the muffler 16, and a flow passage 17 penetrating through the stationary scroll 8 and the bearing member 10, in this order. The working fluid then is discharged to the internal space 24 of the closed casing 1. The oil that has reached the compression mechanism 2 through an oil supply passage 29 formed in the shaft 5 lubricates sliding surfaces between the orbiting scroll 7 and the eccentric pivot 5*a* and sliding surfaces between the orbiting scroll 7 and the stationary scroll 8. The working fluid discharged to the internal space 24 of the closed casing 1 is separated from the oil by a gravitational force or centrifugal force while staying in the internal space 24. Thereafter, the working fluid is discharged to a gas cooler through a discharge pipe 15.

<<Motor 4>>

The motor 4 for driving the compression mechanism 2 via the shaft 5 includes a stator 21 fixed to the closed casing 1 and a rotor 22 fixed to the shaft 5. Electric power is supplied from a terminal (not shown) disposed at the upper part of the closed casing 1 to the motor 4. The motor 4 may be either a synchronous machine or an induction machine. The motor 4 is cooled by the oil contained in the working fluid discharged from the compression mechanism 2.

<<Shaft 5>>

The oil supply passage 29 leading to the sliding parts of the compression mechanism 2 is formed in the shaft 5 so as to extend in the axial direction. The oil discharged from the oil pump 6 is fed into the oil supply passage 29. The oil fed into the oil supply passage 29 is supplied to each of the sliding parts of the compression mechanism 2 without passing through the expansion mechanism 3. With such a configuration, the heat transfer from the compression mechanism 2 to the expansion mechanism 3 via the oil can be suppressed effectively because the oil flowing toward the compression mechanism 2 is not cooled by the expansion mechanism 3. Moreover, the formation of the oil supply passage 29 in the shaft 5 is desirable because neither an increase in the parts count nor a problem of layout of the parts arises additionally.

Furthermore, in the present embodiment, the shaft 5 includes a first shaft 5*s* located on a side of the compression mechanism 2, and a second shaft 5*t* coupled to the first shaft 5*s* and located on a side of the expansion mechanism 3. The oil supply passage 29 leading to the sliding parts of the compression mechanism 2 is formed in the first shaft 5*s* and the second shaft 5*t* so as to extend in the axial direction. The first shaft 5*s* and the second shaft 5*t* are coupled to each other with a coupler 63 so that the power recovered by the expansion mechanism 3 is transferred to the compression mechanism 2. However, the first shaft 5*s* and the second shaft 5*t* may be engaged directly to each other without using the coupler 63. Furthermore, it also is possible to use a shaft formed of a single component.

<<Expansion Mechanism 3>>

The expansion mechanism 3 includes a first cylinder 42, a second cylinder 44 with a larger thickness than that of the first cylinder 42, and an intermediate plate 43 for separating the cylinders 42 and 44 from each other. The first cylinder 42 and the second cylinder 44 are disposed concentrically with each other. The expansion mechanism 3 further includes: a first piston 46 that allows an eccentric portion 5*c* of the shaft 5 to be fitted thereinto and performs eccentric rotational motion in the first cylinder 42; a first vane 48 that is retained reciprocably in a vane groove 42*a* (see FIG. 2A) of the first cylinder 42 and is in contact with the first piston 46 at one end; a first spring 50 that is in contact with the other end of the first vane 48 and pushes the first vane 48 toward the first piston 46; a second piston 47 that allows an eccentric portion 5*d* of the shaft 5 to be fitted thereinto and performs eccentric rotational motion in the second cylinder 44; a second vane 49 that is retained reciprocably in a vane groove 44*a* (see FIG. 2B) of the second cylinder 44 and is in contact with the second piston 47 at one end; and a second spring 51 that is in contact with the other end of the second vane 49 and pushes the second vane 49 toward the second piston 47.

The expansion mechanism 3 further includes an upper bearing member 45 and a lower bearing member 41 disposed so as to sandwich the first cylinder 42, the second cylinder 44, and the intermediate plate 43 therebetween. The intermediate plate 43 and the lower bearing member 41 sandwich the first cylinder 42 from the top and bottom, and the upper bearing member 45 and the intermediate plate 43 sandwich the second cylinder 44 from the top and bottom. Sandwiching the first cylinder 42 and the second cylinder 44 by the upper bearing member 45, the intermediate plate 43, and the lower bearing member 41 forms, in the first cylinder 42 and the second cylinder 44, working chambers whose volumetric capacities vary in accordance with the rotations of the pistons 46 and 47. Like the compression mechanism 2, the expansion mechanism 3 also includes a suction pipe 52 and a discharge pipe 53.

As shown in FIG. 2A, a suction-side working chamber 55*a* (first suction-side space) and a discharge-side working chamber 55*b* (first discharge-side space) are formed in the first cylinder 42. The suction-side working chamber 55*a* and the discharge-side working chamber 55*b* are demarcated by the first piston 46 and the first vane 48. As shown in FIG. 2B, a suction-side working chamber 56*a* (second suction-side space) and a discharge-side working chamber 56*b* (second discharge-side space) are formed in the second cylinder 44. The suction-side working chamber 56*a* and the discharge-side working chamber 56*b* are demarcated by the second piston 47 and the second vane 49. The total volumetric capacity of the two working chambers 56*a* and 56*b* in the second cylinder 44 is larger than the total volumetric capacity of the two working chambers 55*a* and 55*b* in the first cylinder 42. The discharge-side working chamber 55*b* in the first cylinder 42 and the suction-side working chamber 56*a* of the second cylinder 44 are connected to each other via a through hole 43*a* formed in the intermediate plate 43 so as to function as a single working chamber (expansion chamber). The working fluid having a high pressure flows through the suction pipe 52 and a suction passage 54, and then flows into the working chamber 55*a* of the first cylinder 42 through a suction port 41*a* formed in the lower bearing member 41. The working fluid that has flowed into the working chamber 55*a* of the first cylinder 42 expands and reduces its pressure in the expansion chamber composed of the working chambers 55*a* and 55*b* while rotating the shaft 5. Then, the working fluid is guided to the outside through a discharge port 45*a* and the discharge pipe 53.

As described above, the expansion mechanism 3 is a rotary-type mechanism including: the cylinders 42 and 44; the pistons 46 and 47 disposed in the cylinders 42 and 44 so that the eccentric portions 5*c* and 5*d* of the shaft 5 are fitted thereinto, respectively; and the bearing members 41 and 45 (closing members) that close the cylinders 42 and 44, respectively, and form the expansion chamber together with the cylinders 42 and 44 and the pistons 46 and 47. In a rotary-type fluid mechanism, it is necessary to lubricate a vane that partitions a space in the cylinder into two spaces due to its structural limitations. When the entire mechanism is immersed in the oil, the vane can be lubricated in a remarkably simple manner, specifically, by exposing a rear end of the vane groove in which the vane is disposed to an interior of the closed casing 1. The vanes 48 and 49 are lubricated in such a manner also in the present embodiment.

Figure 5:
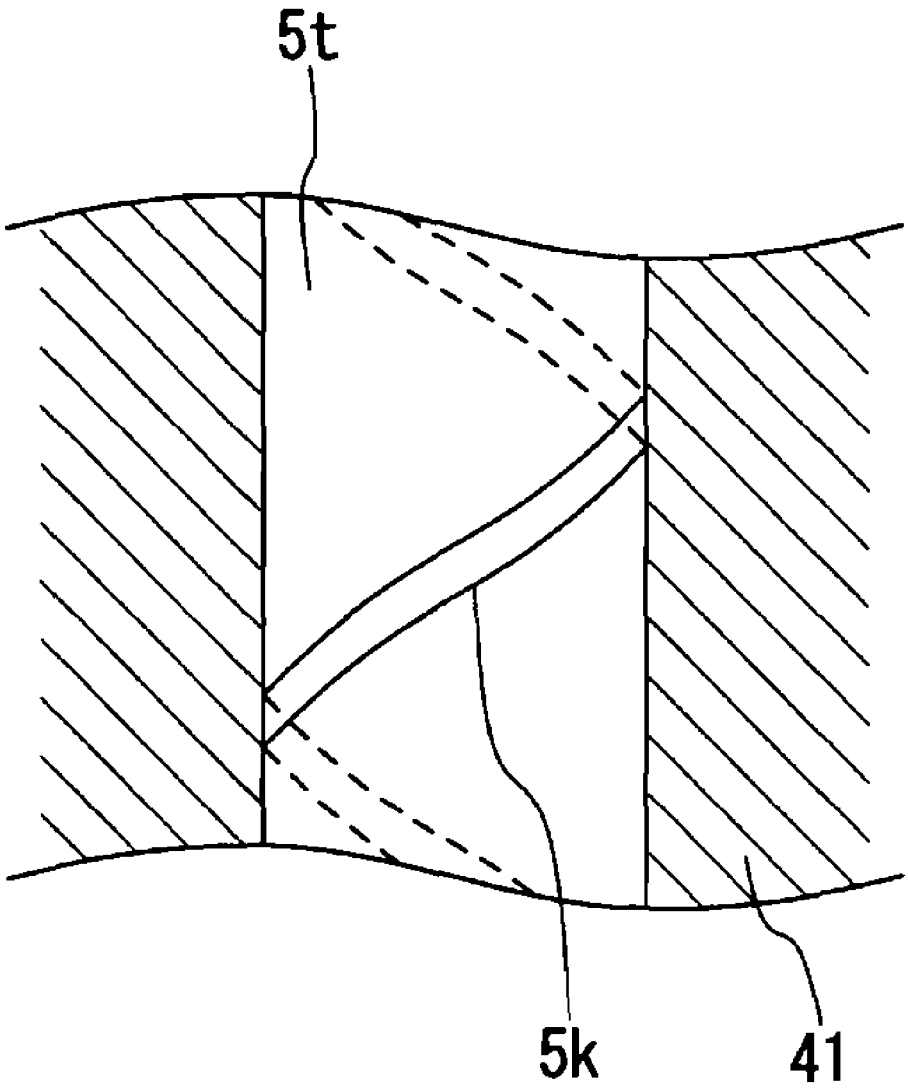
FIG. 5 is a schematic view showing an oil supply groove formed in an outer circumferential surface of a second shaft.

The oil supply to other parts (the bearing members 41 and 45, for example) can be performed by, for example, forming a groove 5*k* in an outer circumferential surface of the second shaft 5*t* so as to extend from a lower end of the second shaft 5*t* toward the cylinders 42 and 44 of the expansion mechanism 3, as shown in FIG. 5. The pressure applied to the oil held in the oil reservoir 25 is higher than the pressure applied to the oil that is lubricating the cylinders 42 and 44 and the pistons 46 and 47. Thus, the oil can be supplied to the sliding parts of the expansion mechanism 3 by flowing through the groove 5*k* formed in the outer circumferential surface of the second shaft 5*t* without the aid of the oil pump.

<<Oil Pump 6>>

As shown in FIG. 3, the oil pump 6 is a positive displacement pump configured to pump the oil by an increase or decrease in the volumetric capacity of the working chamber as the shaft 5 rotates. A hollow relay member 71 accommodating the coupler 63 is provided adjacent to the oil pump 6. The shaft 5 extends so as to penetrate through centers of the oil pump 6 and the relay member 71.

Figure 4:
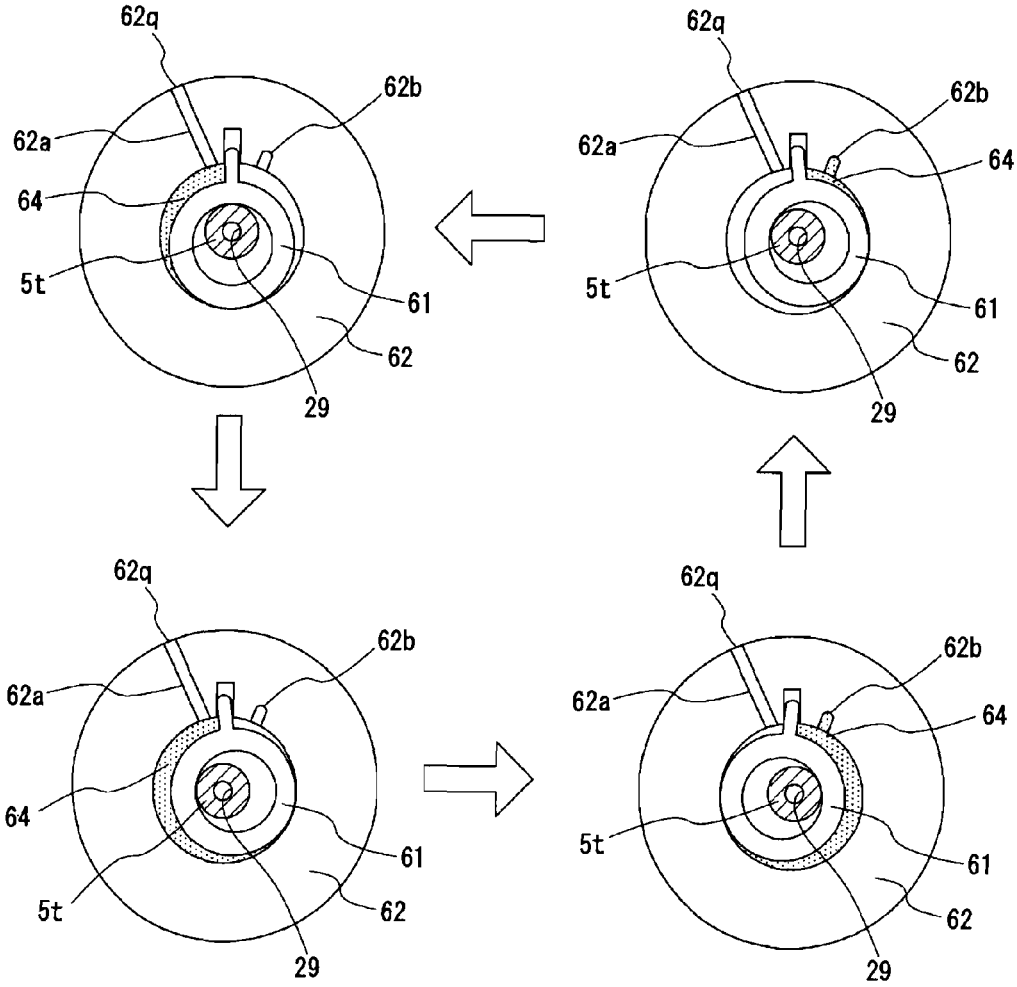
FIG. 4 is a plan view of an oil pump.

FIG. 4 shows a plan view of the oil pump 6. The oil pump 6 includes a piston 61 attached to the eccentric portion of the shaft 5 (the second shaft 5*t*), and a housing 62 (cylinder) accommodating the piston 61. A crescent-shaped working chamber 64 is formed between the piston 61 and the housing 62. More specifically, the oil pump 6 employs a rotary-type fluid mechanism. In the housing 62, there are formed an oil suction passage 62*a* connecting the oil reservoir 25 (specifically the upper tank 25*a*) to the working chamber 64, and an oil discharge passage 62*b* and a relay passage 62*c* connecting the working chamber 64 to the oil supply passage 29 (see FIG. 3). The piston 61 performs eccentric rotational motion in the housing 62 as the second shaft 5*t* rotates. Thereby, the volumetric capacity of the working chamber 64 increases or decreases, so that the oil is drawn thereinto and discharged therefrom. Such a mechanism does not convert the rotational motion of the second shaft 5*t* into another motion by a cam mechanism or the like but directly utilizes it as the motion for pumping the oil. Therefore, the mechanism has the advantage of the mechanical loss being small. Moreover, the mechanism is highly reliable because it has a relatively simple structure.

The oil pump 6 and the relay member 71 are disposed vertically adjacent to each other in the axial direction so that an upper face of the housing 62 of the oil pump 6 is in contact with a lower face of the relay member 71. The relay member 71 is closed by the upper face of the housing 62. Furthermore, the relay member 71 has a bearing portion 76 for supporting the shaft 5 (the first shaft 5*s*). In other words, the relay member 71 also has a function as a bearing for supporting the shaft 5. In order to lubricate the bearing portion 76, the oil supply passage 29 formed in the shaft 5 is branched in a section corresponding to the bearing portion 76. The support frame 75 may have a portion equivalent to the bearing portion 76. Furthermore, the support frame 75 and the relay member 71 may be formed of a single component.

The first shaft 5*s* and the second shaft 5*t* are coupled to each other with the coupler 63. The coupler 63 is disposed in an internal space 70*h* of the relay member 71. The first shaft 5*s* and the coupler 63 are coupled to each other so as to rotate synchronously by, for example, allowing a groove formed in an outer circumferential surface of the first shaft 5*s* to be engaged with a groove formed in an inner circumferential surface of the coupler 63. The second shaft 5*t* and the coupler 63 also can be fixed to each other in the same manner. The coupler 63 rotates synchronously with the first shaft 5*s* and the second shaft 5*t* in the relay member 71. The torque applied to the second shaft 5*t* by the expansion mechanism 3 is transferred to the first shaft 5*s* via the coupler 63.

The oil supply passage 29 is formed across the first shaft 5*s* and the second shaft 5*t*. A coupling portion of the shaft 5, an inlet 29*p* of the oil supply passage 29, and a main body of the oil pump 6 are arranged in this order from a side closer to the compression mechanism 2. The inlet 29*p* of the oil supply passage 29 is formed in the outer circumferential surface of the second shaft 5*t*, between an upper end portion of the second shaft 5*t* and the portion (eccentric portion) of the second shaft 5*t* fitted into the piston. The relay passage 62*c* is an annular space surrounding the second shaft 5*t* in its circumferential direction. The inlet 29*p* of the oil supply passage 29 faces the annular space.

The oil discharged from the oil pump 6 is guided to the oil supply passage 29 through the oil discharge passage 62*b* and the relay passage 62*c*. The relay member 71 serves as a housing for accommodating the coupler 63 as well as a bearing for the shaft 5. The internal space 70*h* of the relay member 71 may be filled with the oil.

<<Heat Insulating Structure 30>>

As shown in FIG. 1, the heat insulating structure 30 is composed of a separate component from the upper bearing member 45 (closing member) of the expansion mechanism 3. This makes it possible to ensure a sufficient distance from the oil pump 6 to the second cylinder 44, and obtain a higher heat insulation effect.

Specifically, the heat insulating structure 30 includes the partition plate 31 separating the upper tank 25*a* from the lower tank 25*b*, and spacers 32 and 33 disposed between the partition plate 31 and the expansion mechanism 3. The spacers 32 and 33 form, between the partition member 31 and the expansion mechanism 3, a space filled with the oil held in the lower tank 25*b*. The oil itself filling the space ensured by the spacers 32 and 33 serves as a heat insulator and forms a thermal stratification in the axial direction.

An upper face of the partition plate 31 is in contact with a lower face of the housing 62 of the oil pump 6. That is, the working chamber 64 in the housing 62 is closed by the upper face of the partition plate 31. The partition member 31 has, at a center thereof, a through hole for allowing the shaft 5 to extend therethrough. The material constituting the partition plate 31 may be metal such as carbon steel, cast iron, and alloy steel. The thickness of the partition plate 31 is not particularly limited, and does not need to be uniform as in the present embodiment, either.

Preferably, the shape of the partition plate 31 conforms to the lateral cross sectional shape of the closed casing 1 (see FIG. 2). In the present embodiment, the partition plate 31 with a circular outer shape is employed. The size of the partition plate 31 is not limited as long as it can restrict sufficiently the oil flow between the upper tank 25*a* and the lower tank 25*b*. Specifically, it is appropriate when the partition plate 31 has an outer diameter almost equal to or slightly smaller than an inner diameter of the closed casing 1.

As shown in FIG. 1, a gap 77 is formed between an inner surface of the closed casing 1 and an outer circumferential surface of the partition plate 31. The width of the gap 77 may be the minimum necessary so as to allow the oil to flow between the upper tank 25*a* and the lower tanks 25*b*. For example, it may be 0.5 mm to 1 mm in terms of a length in a radial direction of the shaft 5. This makes it possible to keep the oil flow between the upper tank 25*a* and the lower tank 25*b* to the minimum necessary.

The gap 77 may or may not be formed around an entire circumference of the partition plate 31. For example, a cut out serving as the gap 77 may be provided at one or more locations in an outer peripheral portion of the partition plate 31. Instead of the gap 77 or together with the gap 77, a through hole (micropore) that allows the oil to flow therethrough may be formed in the partition plate 31. It is desirable that such a through hole be spaced apart from (not be overlapped in the vertical direction with) the oil suction port 62*q* of the oil pump 6 and the through hole 75*a* of the support frame 75, along a lateral direction perpendicular to the vertical direction. This is because such a positional relationship allows the high temperature oil to be drawn into the oil pump 6 preferentially, and lowers the possibility of the high temperature oil moving to the lower tank 25*b* through the through hole of the partition plate 31.

The spacers 32 and 33 include a first spacer 32 disposed around the shaft 5 and a second spacer 33 disposed radially outside of the first spacer 32. In the present embodiment, the first spacer 32 is circular cylindrical and functions as a cover for covering the second shaft 5*t*. Furthermore, the first spacer 32 may function as a bearing for supporting the second shaft 5*t*. The second spacer 33 may be a bolt or a screw used for fixing the expansion mechanism 3 to the support frame 75, a member with a hole for allowing the bolt or screw to extend therethrough, or a member for merely ensuring a space. Furthermore, the spacers 32 and 33 may be integrated with the partition plate 31. In other words, the spacers 32 and 33 may be welded or brazed to the partition plate 31, or the spacers 32, 33 and the partition plate 31 may be an integrated member.

A portion of the second shaft 5*t* above the partition plate 31 has a high temperature because it extends through the oil pump 6 and projects into the relay member 71. Thus, when the second shaft 5*t* is exposed to the space formed by the heat insulating structure 30 and is in contact with the oil held in the lower tank 25*b*, the heat transfer from the upper tank 25*a* to the lower tank 25*b* tends to occur easily via the second shaft 5*t*. Covering the second shaft 5*t* with the first spacer 32 as in the present embodiment can prevent the oil filling the space formed by the heat insulating structure 30 from contacting the second shaft 5*t* directly and being heated. That is, the heat transfer via the second shaft 5*t* can be suppressed by the first spacer 32. Also, the first spacer 32 can prevent the second shaft 5*t* from stirring the oil held in the lower tank 25*b*.

The effect of suppressing the heat transfer via the second shaft 5*t* is enhanced further when the first spacer 32 has a lower heat conductivity than those of the partition plate 31 and the second shaft 5*t*. For example, the partition plate 31 and the second shaft 5*t* may be made of cast iron, and the first spacer 32 may be made of stainless steel such as SUS 304. For the same reason, it is desirable that the second spacer 33 also be made of metal with a low heat conductivity. Of course, the partition plate 31 and the second shaft 5*t* may be made of stainless steel with a low heat conductivity. The high/low of the heat conductivity means high/low in an ordinary temperature range of the oil (0° C. to 100° C., for example) during operation of the expander-compressor unit 200A.

<<Oil Supply Passage 29>>

Originally, the oil supply passage 29 is provided to supply the oil. In the present invention, however, the oil supply passage 29 itself also has a function of suppressing the heat transfer. Specifically, as shown in FIG. 1 and FIG. 3, a lower end 29*e* of the oil supply passage 29 is located below the inlet 29*p* formed in the outer circumferential surface of the shaft 5. The oil supply passage 29 dead-ends at the lower end 29*e*, and thus the oil stays in a portion of the oil supply passage 29 below the inlet 29*p*. Since the heat conductivity of the oil is lower than that of the shaft 5, the heat insulation effect can be obtained by allowing the oil to stay therein.

The diameter of the oil supply passage 29 is not particularly limited. There is no problem in increasing the diameter of the oil supply passage 29 to some extent within the range that allows the shaft 5 to have a sufficient strength. In such a configuration, the oil tends to stay easily in the oil supply passage 29, increasing the heat insulation effect. For example, the oil supply passage 29 may be formed so that the oil supply passage 29 has a radius larger than the wall thickness of the shaft 5 (5*t*) in the radial direction. The number of the inlet 29*p* of the oil supply passage 29 is not limited to one. The inlets 29*p* may be provided at a plurality of locations on the shaft 5 along its circumferential direction. When a plurality of the inlets 29*p* are provided, the flow velocity of the oil flowing into the oil supply passage 29 is lowered. Thereby, the oil tends to stay stably in the portion of the oil supply passage 29 below the inlet 29*p*.

In the present embodiment, the inlet 29*p* of the oil supply passage 29 is located above the main body of the oil pump 6, and the oil supply passage 29 includes a portion that is overlapped with the main body of the oil pump 6 along the axial direction. The main body of the oil pump 6 means a portion in which the piston 61 and the working chamber 64 are located. As described earlier, the oil pump 6 draws the oil having a relatively high temperature, and the oil is guided to the oil supply passage 29. Thus, the oil pump 6 itself also has a relatively high temperature when the expander-compressor unit 200A is being operated. When the inlet 29*p* of the oil supply passage 29 is located above the main body of the oil pump 6, and the portion in which the oil stays is overlapped with the oil pump 6 along the axial direction, the heat transfer from the oil pump 6 to the shaft 5 (5*t*) can be suppressed. Specifically, in the present embodiment, the oil supply passage 29 is formed so that the lower end 29*e* is located at the height at which the partition plate 31 is located.

Usually, the oil supply passage 29 is formed in the shaft 5 by drilling the shaft 5 with a drill. Due to requirements for processing, the lower end 29*e* of the oil supply passage 29 certainly is located approximately 2 mm to 3 mm below the inlet 29*p*. Such a very minor gap generated from the requirements for processing does not allow the oil to stay therein, and this does not mean that the lower end 29*e* of the oil supply passage 29 is located below the inlet 29*p*. In order to allow the oil to stay in the oil supply passage 29 and obtain the heat insulation effect, it is preferable that approximately 10 mm, for example, is ensured for the portion of the oil supply passage 29 below the inlet 29*p*.

Figure 6:
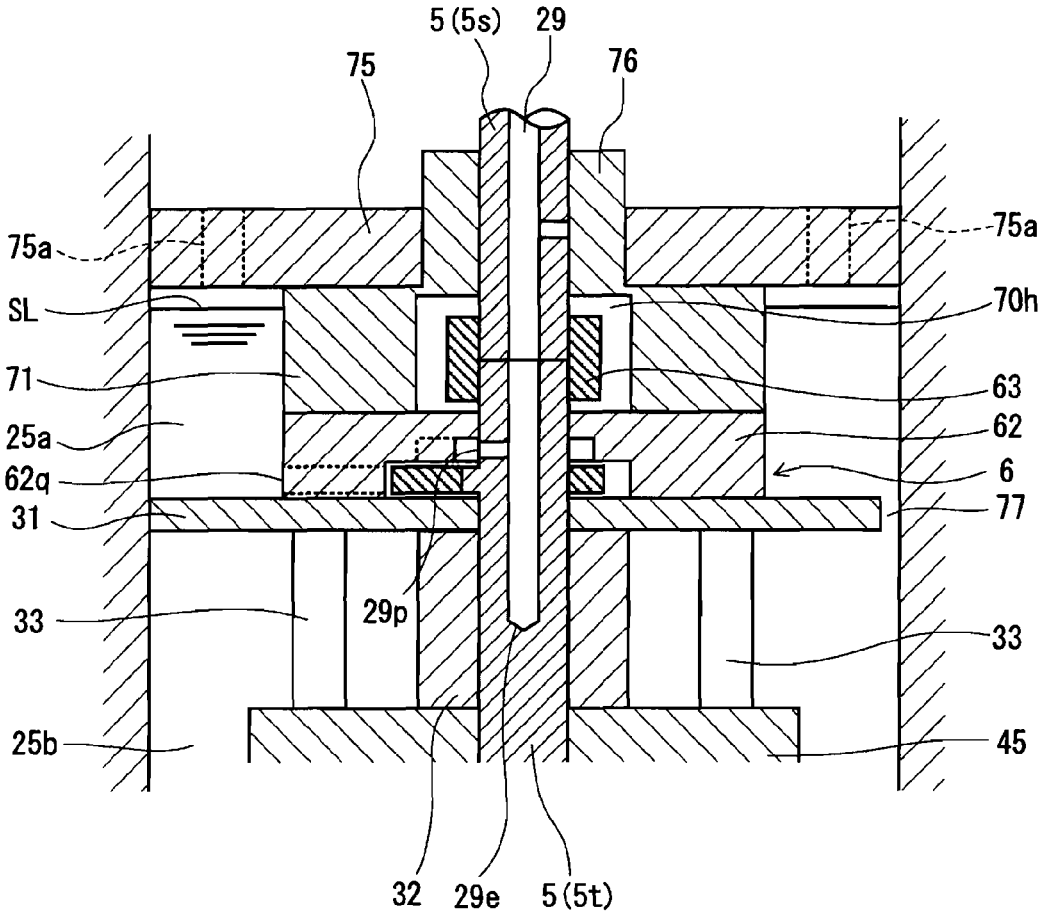
FIG. 6 is an enlarged cross-sectional view showing another form of an oil supply passage.

Moreover, as shown in FIG. 6, the oil supply passage 29 may include a portion overlapped with the heat insulating structure 30 along the axial direction. Such a configuration increases further the effect of suppressing the heat transfer from the oil pump 6 to the shaft 5 (5*t*). Specifically, it is preferable that the lower end 29*e* of the oil supply passage 29 is positioned within the range of the spacers 32 and 33 in the axial direction.

Figure 7:
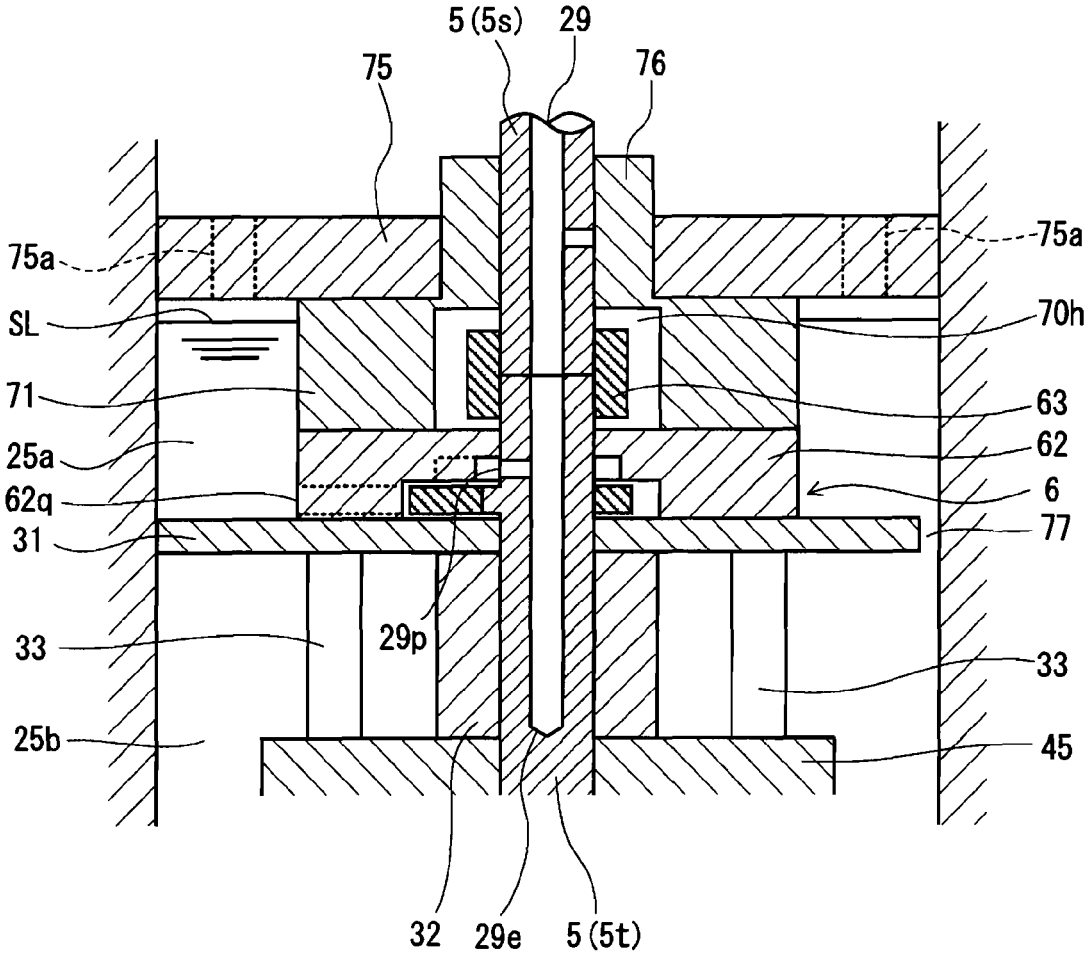
FIG. 7 is an enlarged cross-sectional view showing still another form of the oil supply passage.

As shown in FIG. 7, the expansion mechanism 3 of the present embodiment has, on the side of the compression mechanism 2, the upper bearing member 45 for supporting the shaft 5 (5*t*). Thus, it is desirable that the lower end 29*e* of the oil supply passage 29 be located above the upper bearing member 45. That is, the oil supply passage 29 ends above the upper bearing member 45. Such a configuration prevents a portion supported by the upper bearing member 45 from being hollow, which is preferable from the view point of ensuring the strength of the shaft 5 (5*t*) and suppressing the warpage of the shaft 5 (5*t*).

Figure 8:
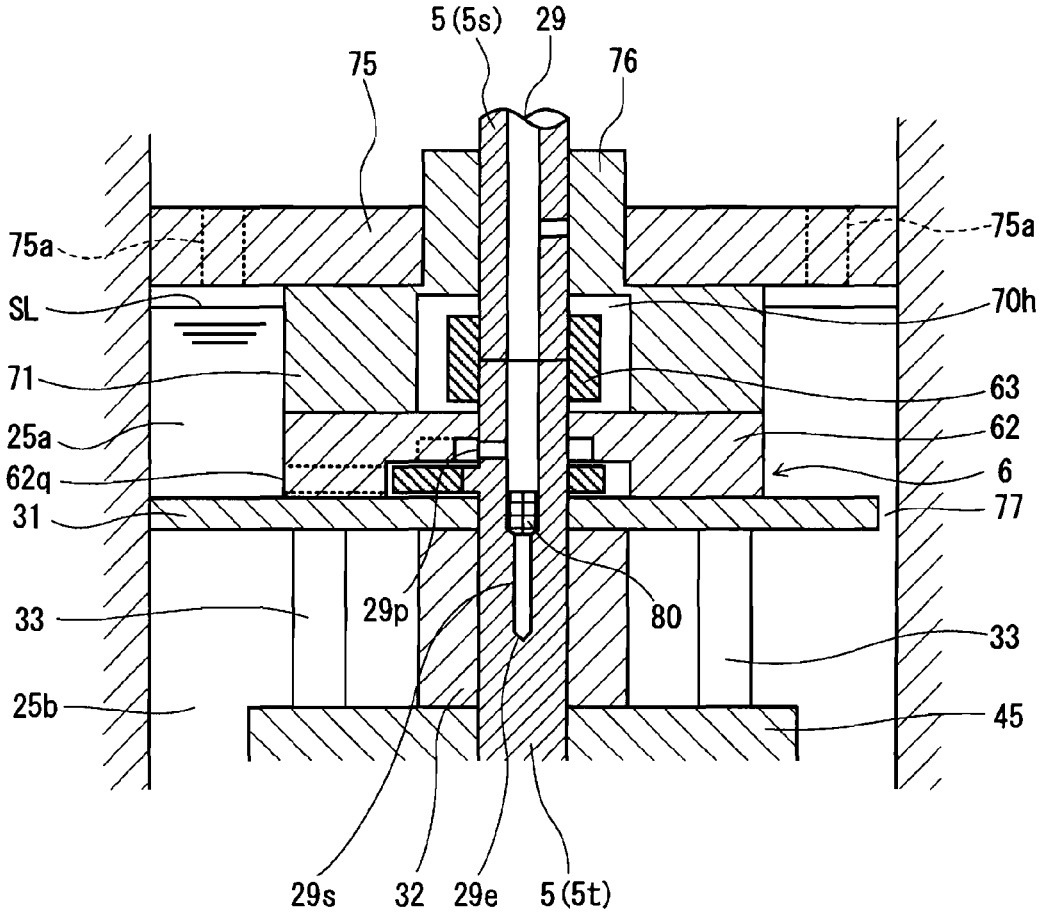
FIG. 8 is an enlarged cross-sectional view showing still another form of the oil supply passage.

As shown in FIG. 8, the oil supply passage 29 may have a trap 80 for suppressing the flow of the oil. The trap 80 is provided below the inlet 29*p*. With the trap 80, the oil tends to stay easily. The trap 80 may be provided in contact with or spaced apart from the lower end 29*e* of the oil supply passage 29. In the example shown in FIG. 8, the trap 80 is located between the inlet 29*p* and the lower end 29*e*. The trap 80 is not limited as long as it enhances the effect of allowing the oil to stay, and the form thereof is not particularly limited. For example, a mesh made of metal or resin can be used as the trap 80. Preferably, the diameter of the oil supply passage 29 is reduced at a portion 29*s* below the trap 80 so that the trap 80 is seated and positioned.

Figure 9:
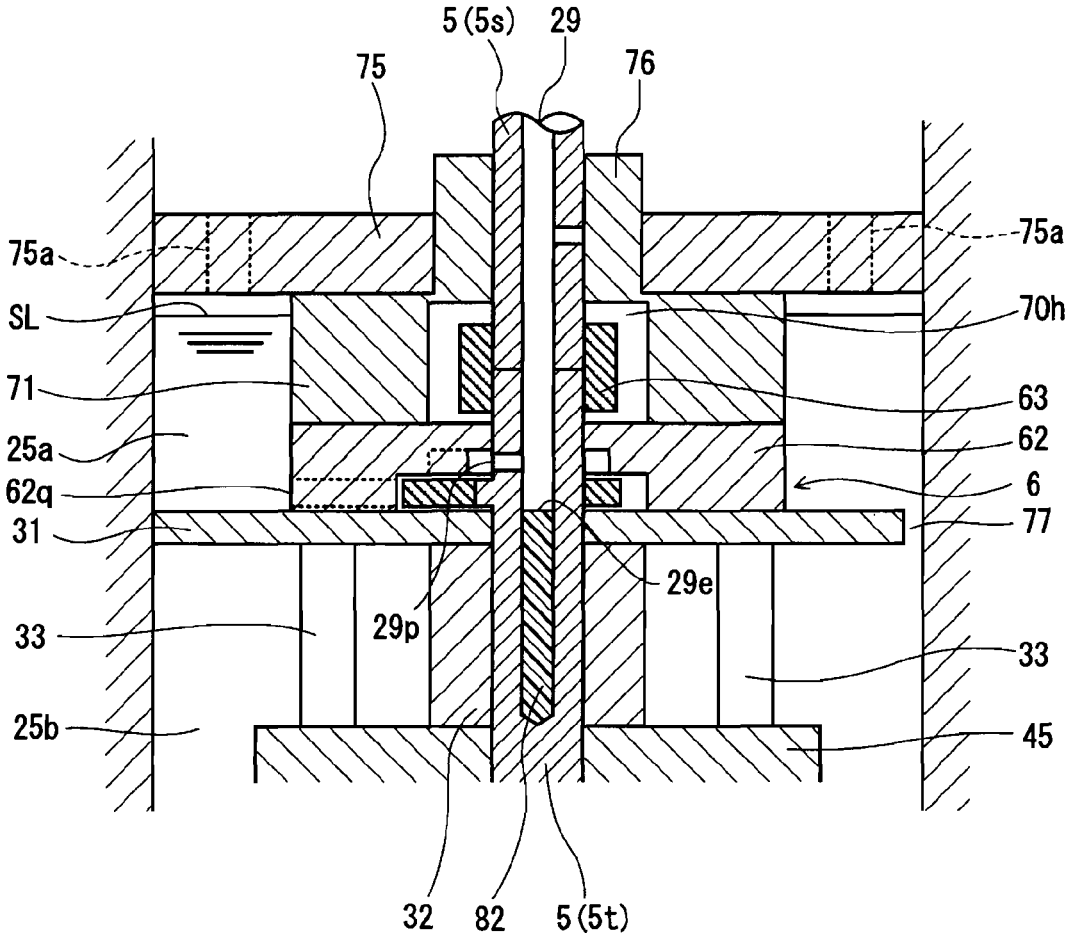
FIG. 9 is an enlarged cross-sectional view showing still another form of the oil supply passage.

Alternatively, as shown in FIG. 9, a heat insulating material 82 may be inserted inside the shaft 5 (5*t*), on a side closer to the expansion mechanism 3 than the lower end 29*e* of the oil supply passage 29. In this case, an upper end of the heat insulating material 82 coincides with the lower end 29*e* of the oil supply passage 29. The insertion of the heat insulating material 82 increases the heat resistance of the shaft 5 (5*t*) and makes it further unlikely for the heat to be transferred via the shaft 5 (5*t*) serving as a heat conductive passage. Preferably, the heat insulating material 82 is made of a material, such as resin, ceramic, and glass, having a lower heat conductivity than that of the metal constituting the shaft 5. The heat insulating material 82 may be provided in the oil supply passage 29 instead of or together with the trap 80 described with reference to FIG. 8.

Embodiment 2

Figure 10:
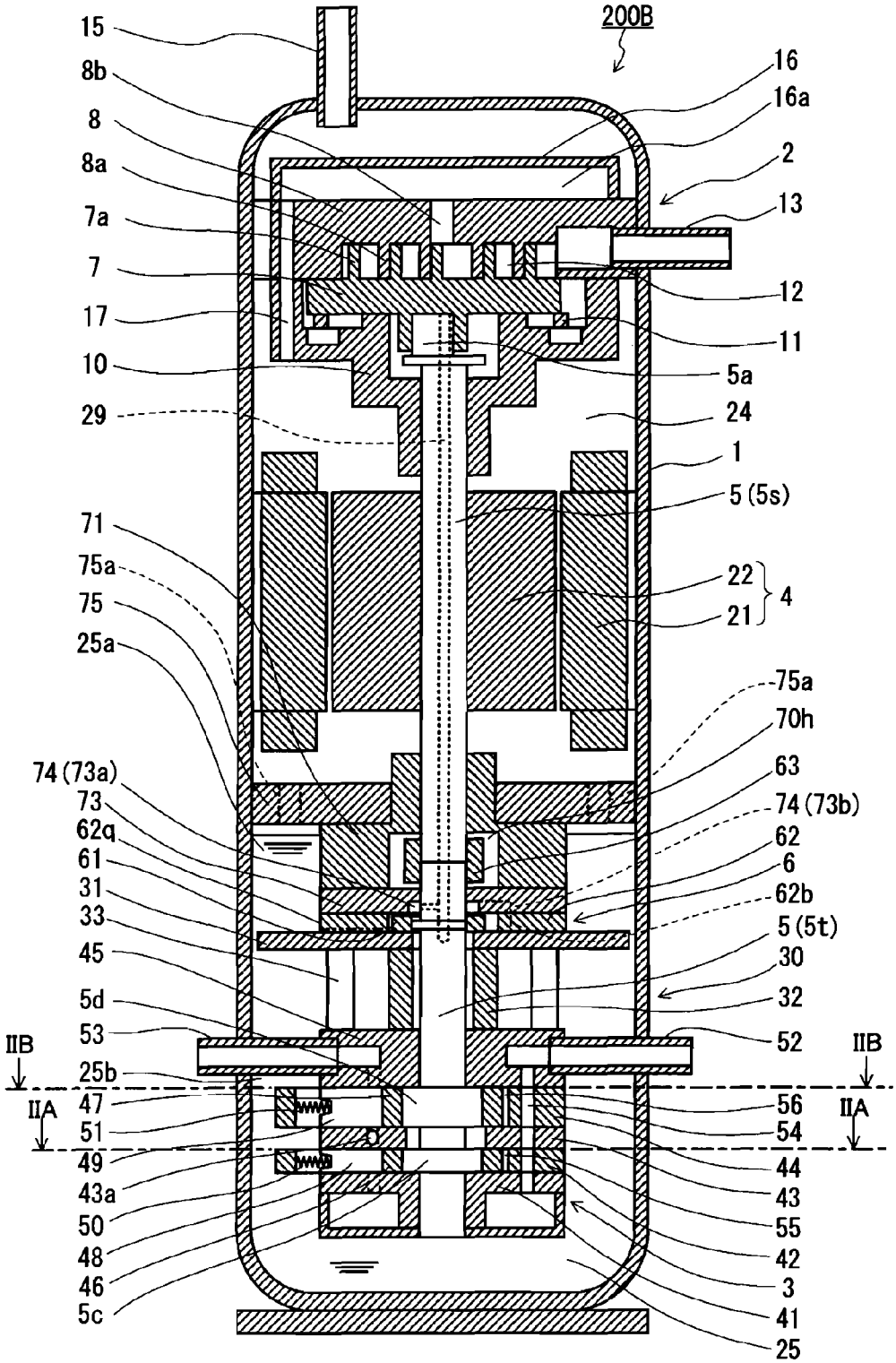
FIG. 10 is a vertical cross-sectional view of an expander-compressor unit according to Embodiment 2 of the present invention.
Figure 11:
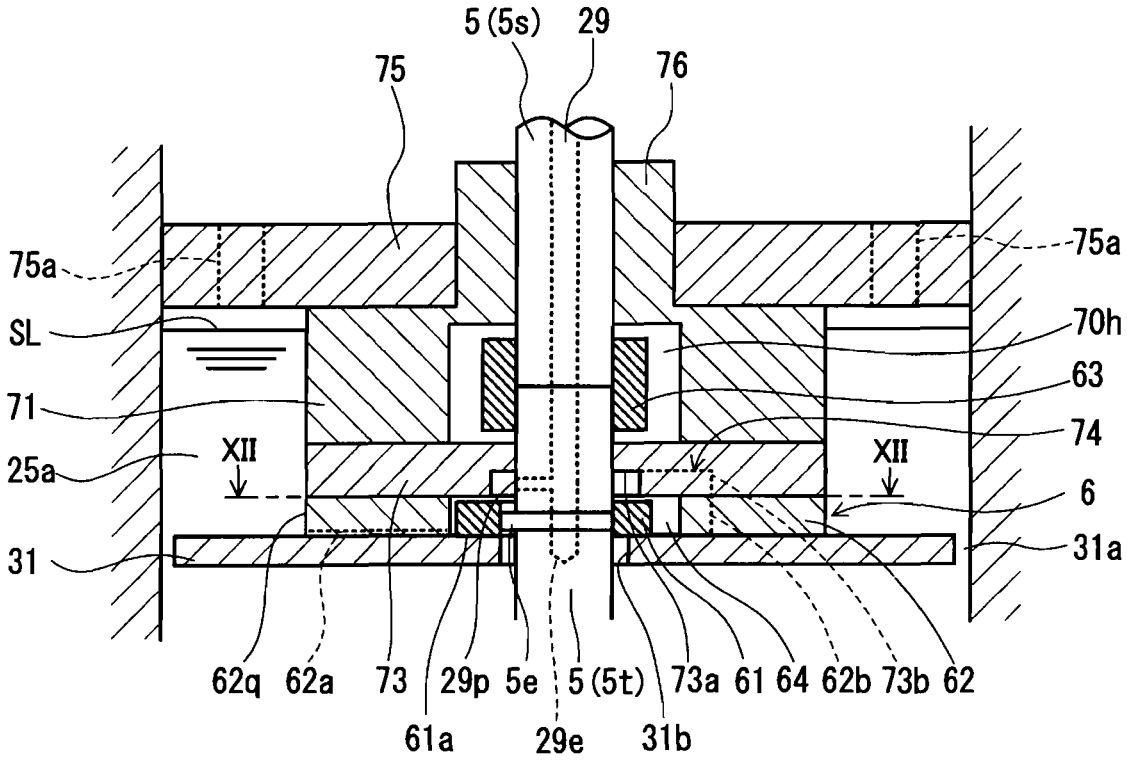
FIG. 11 is a partially enlarged view of FIG. 10.

FIG. 10 is a vertical cross-sectional view of an expander-compressor unit according to Embodiment 2 of the present invention. FIG. 11 is a partially enlarged view of FIG. 10. The transverse cross-sectional view of the expander-compressor unit shown in FIG. 10 taken along the line IIA-IIA is the same as in FIG. 2A, and the transverse cross-sectional view taken along the line IIB-IIB is the same as in FIG. 2B.

In an expander-compressor unit 200B according to the Embodiment 2, the configuration of the oil pump 6 itself and the configuration around it are different from those in the expander-compressor unit 200A according to the Embodiment 1. The configurations of other components in the expander-compressor unit 200B according to the Embodiment 2 are basically the same as those in the expander-compressor unit 200A according to the Embodiment 1. Thus, these components are indicated by the same reference numerals and explanations thereof are omitted. In the Embodiment 2, the partition plate 31 of the Embodiment 1 is referred to as a partition member 31.

In the present embodiment, the partition member 31, which separates the upper tank 25*a* from the lower tank 25*b* and restricts the oil flow therebetween, is in the shape of a disk slightly smaller than a cross section of the internal space 24 of the closed casing 1. A slight amount of the oil is allowed to flow through a gap 31*a* (see FIG. 3) formed between an end face of the partition member 31 and an inner circumferential surface of the closed casing 1. The partition member 31 has, at a center thereof, a through hole 31*b* (see FIG. 11) for allowing the shaft 5 to extend therethrough. Although the diameter of the through hole 31*b* is set slightly larger than that of the shaft 5 in the present embodiment, it may be set equivalent to the diameter of the shaft 5.

The partition member 31 is not limited as long as it serves to separate the the shape of a plate that is squashed in the vertical direction.

Figure 12:
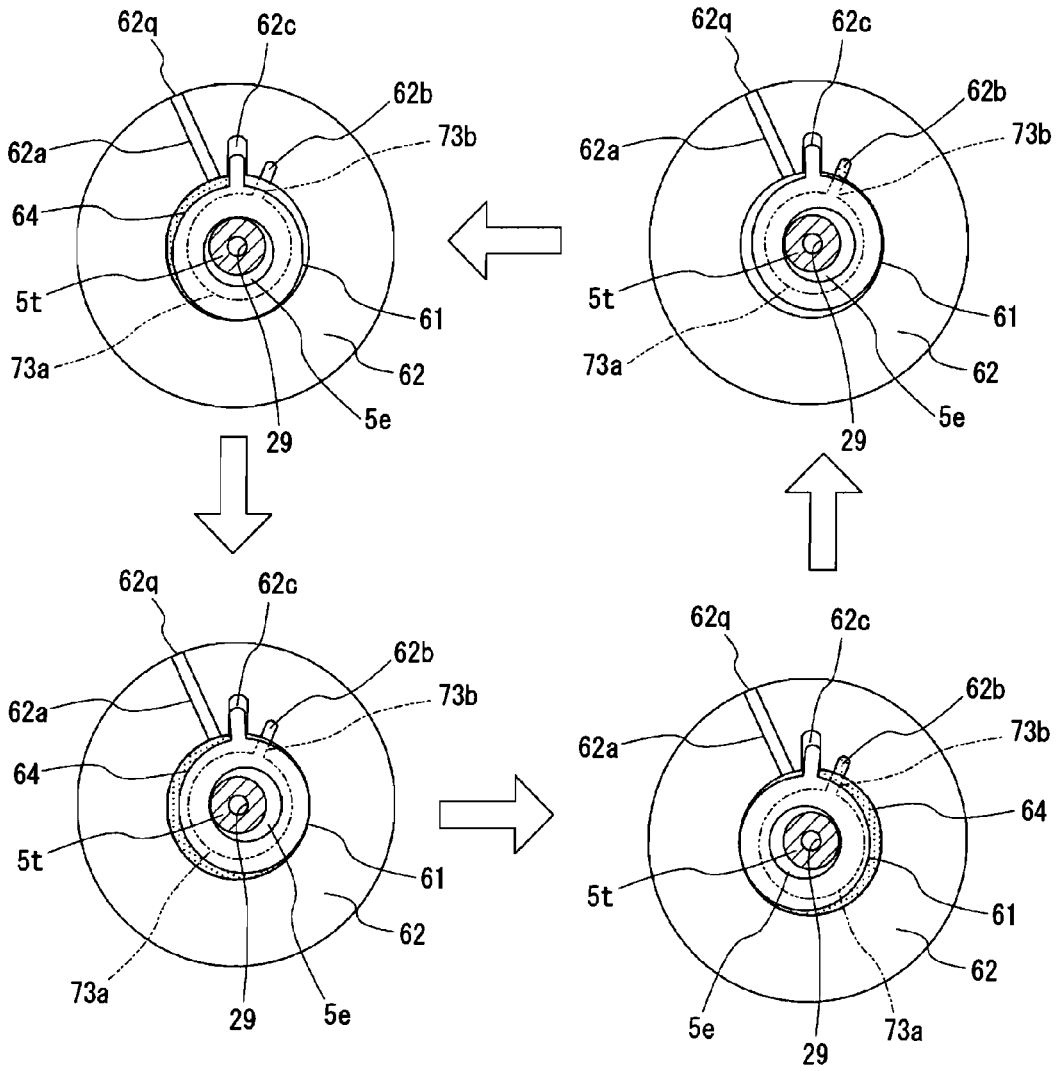
FIG. 12 is a plan view of the oil pump taken along the line XII-XII in FIG. 11.

FIG. 12 shows a plan view of the oil pump 6. The shaft 5 (the second shaft 5*t*) has an eccentric portion 5*e* at a position corresponding to the oil pump 6. The oil pump 6 has the piston 61 that allows the eccentric portion 5*e* of the shaft 5 to be fitted thereinto and performs eccentric motion, and the housing 62 (cylinder) accommodating the piston 61. The crescent-shaped working chamber 64 is formed between the piston 61 and the housing 62. More specifically, the oil pump 6 employs a rotary-type fluid mechanism. As shown in FIG. 12, in the present embodiment, the oil pump 6 has a configuration in which the piston 61 cannot self-rotate. However, the oil pump 6 is not limited as long as it is a positive displacement pump. The oil pump 6 may be another rotary-type pump in which a slide vane is provided and the piston 61 can self-rotate, or may be a gear-type pump such as a trochoid pump.

In the housing 62, there are formed the suction passage 62*a* connecting the upper tank 25*a* of the oil reservoir 25 to the working chamber 64, and the discharge passage 62*b* that allows the oil to escape from the working chamber 64. The suction passage 62*a* extends on a straight line along an upper face of the housing 62. The discharge passage 62*b* is in the shape of a groove that recesses from an inner circumferential surface of the housing 62 toward outside in a radial direction. The suction port 62*q* is formed by an outside opening of the suction passage 62*a*, and the discharge port is formed by an upper opening of the discharge passage 62*b*. A lower opening of the discharge passage 62*b* is closed by the partition member 31. When the piston 61 performs eccentric motion in the housing 62 as the second shaft 5*t* rotates, the volumetric capacity of the working chamber 64 increases or decreases accordingly, so that the oil is drawn thereinto from the suction port 62*q* and the oil is discharged upward from the discharge port. Such a mechanism does not convert the rotational motion of the second shaft 5*t* into another motion by a cam mechanism or the like but directly utilizes it as the motion for pumping the oil. Therefore, the mechanism has the advantage of the mechanical loss being small. Moreover, the mechanism is highly reliable because it has a relatively simple structure.

As shown in FIG. 11, the introduction member 73 is disposed adjacent to the housing 62 so that a lower face of the introduction member 73 is in contact with the upper face of the housing 62, and the partition member 31 is disposed adjacent to the housing 62 so that the upper face of the partition member 31 is in contact with the lower face of the housing 62. Thereby, the working chamber 64 is closed by the introduction member 73 from the top and is closed by the partition member 31 from upper tank 25*a* and the lower tank 25*b* from each other and restrict the oil flow between the upper tank 25*a* and the lower tank 25*b*. The shape and configuration of the partition member 31 can be selected appropriately. For example, it also is possible that the partition member 31 has a diameter equal to an inner diameter of the closed casing 1, and the partition member 31 is provided with a through hole or a cut out from the end face for allowing the oil to flow therethrough. Alternatively, the partition member 31 may be formed into a hollow shape (for example, a reel shape) with a plurality of components so that the oil can be held therein temporarily.

In the present embodiment, the shaft 5 has, at a position slightly above the oil pump 6, the inlet (introduction inlet) 29*p* (see FIG. 11) for introducing the oil into the oil supply passage 29. The oil discharged upward from the oil pump 6 is fed into the oil supply passage 29 through an after-mentioned introduction passage 74 and the inlet 29*p*. The oil fed into the oil supply passage 29 is supplied to each of the sliding parts of the compression mechanism 2 without passing through the expansion mechanism 3. With such a configuration, the heat transfer from the compression mechanism 2 to the expansion mechanism 3 via the oil can be suppressed effectively because the oil flowing toward the compression mechanism 2 is not cooled by the expansion mechanism 3. Moreover, the formation of the oil supply passage 29 in the shaft 5 is desirable because neither an increase in the parts count nor a problem of layout of the parts arises additionally. As in the Embodiment 1, the lower end 29*e* of the oil supply passage 29 is located below the inlet 29*p* formed in the outer circumferential surface of the shaft 5. Below the inlet 29*p*, the oil supply passage 29 can have any of the configurations described with reference to FIG. 3 and FIGS. 6 to 9 in the Embodiment 1.

As shown in FIG. 11, the oil pump 6 is a positive displacement pump configured to pump the oil by an increase or decrease in the volumetric capacity of the working chamber as the shaft 5 rotates. An introduction member 73 and the relay member 71 are disposed in this order above the oil pump 6. The shaft 5 penetrates through centers of the introduction member 73 and the relay member 71. The oil pump 6 is fixed to the support frame 75 via these members 73 and 71.

The relay member 71 has the internal space 70*h* for accommodating the coupler 63, and the bearing portion 76 for supporting the shaft 5 (the first shaft 5*s*). In other words, the relay member 71 serves as a housing for the coupler 63 as well as a bearing for the shaft 5. The support frame 75 may have a portion equivalent to the bearing portion 76. Furthermore, the support frame 75 and the relay member 71 may be formed of a single component. The introduction member 73 has the bottom, and the piston 61 slides on the partition member 31. That is, the introduction member 73 and the partition member 31 serve also as closing members closing the working chamber 64. The housing 62 may be integrated with the partition member 31. An additional closing member that is adjacent to the housing 62 and closes the working chamber 64 from the bottom may be disposed between the oil pump 6 and the partition member 31. In this case, the closing member may be comparable to the housing 62 in size.

The introduction member 73 is provided with the introduction passage 74 allowing the discharge port of the oil pump 6 to be communicated with the inlet 29*p* of the oil supply passage 29. Specifically, an annular stepped portion 73*a* obtained by recessing upwardly a circumferential portion of the introduction member 73 surrounding the shaft 5, and a groove 73*b* extending outwardly in a radial direction of the shaft 5 from the stepped portion 73*a* to a position corresponding to the discharge port of the oil pump 6 are formed in the lower face of the introduction member 73. The stepped portion 73*a* and the groove 73*b* constitute the introduction passage 74. The inlet 29*p* of the oil supply passage 29 is provided in a portion of the shaft 5 facing a space formed by the stepped portion 73*a*, and is opened laterally to the space. The oil discharged upward from the discharge port of the oil pump 6 is fed into the stepped portion 73*a* through the groove 73*b*, and is introduced from here to the oil supply passage 29 through the inlet 29*p* rotating together with the shaft 5. The stepped portion 73*a* has an outer diameter smaller than the diameter of the smallest trajectory circle among those formed by the piston 61 performing eccentric motion. Thus, the space in the stepped portion 73*a* is closed by the piston 61 and a stepped portion 5*e* of the shaft 5 from the bottom, and the introduction passage 74 always faces an upper face of the piston 61. The stepped portion 73*a* does not need to be circular annular, and the shape thereof can be selected appropriately. Moreover, the number of the inlet 29*p* does not need to be one. A plurality of the introduction inlets 29*p* may be provided in accordance with the shape of the stepped portion 73*a*.

Furthermore, in the present embodiment, the eccentric portion 5*e* of the shaft 5 has a smaller thickness than that of the piston 61, and is disposed at a lower position inside the piston 61.

As described above, in the expander-compressor unit 200B of the present embodiment, the lower end 29*e* of the oil supply passage 29 is located below the inlet 29*p*. Therefore, as in the Embodiment 1, the oil stays below the inlet 29*p*, and thereby the heat insulation effect can be obtained.

Furthermore, in the present embodiment, the oil held in the oil reservoir 25 is discharged upward from the oil pump 6, and then introduced into the oil supply passage 29 formed in the shaft 5 through the introduction passage 74 located above the oil pump 6 and the inlet 29*p*. Thus, the oil discharged from the oil pump 6 is supplied to the compression mechanism 2 without approaching the expansion mechanism 3. This makes it further unlikely for the heat to be transferred to the expansion mechanism 3 from the oil discharged from the oil pump 6. As a result, the effect of suppressing the heat transfer via the oil can be enhanced further.

Moreover, in the present embodiment, the partition member 31 is provided and the suction port 62*q* of the oil pump 6 is located above the partition member 31. Thus, a lubrication passage for the oil lubricating the compression mechanism 2 is formed above the partition member 31, making it unlikely for the heat to be transferred to the expansion mechanism 3 also from the oil to be drawn into the oil pump 6.

Furthermore, since the piston 61 of the oil pump 6 slides on the partition member 31 and the introduction passage 74 faces the upper face of the piston 6, the oil flowing through the introduction passage 74 pushes the piston 61 against the partition member 31. Thereby, the sealing between a lower face 61*a* of the piston 61 and the upper face of partition member 31 is enhanced, making it possible to prevent the high temperature oil from leaking below the partition member 31 from a gap therebetween (more specifically, through the through hole 31*b* of the partition member 31). This effect also can be obtained in the same manner when a gear-type oil pump with internal teeth movable along the shaft 5 is used.

Since the eccentric portion 5*e* of the shaft 5 is disposed at a lower position inside the piston 62, a sufficient buffer space can be ensured in immediate front of the inlet 29*p*, and the oil can be supplied to the oil supply passage 29 stably.

Figure 13A:
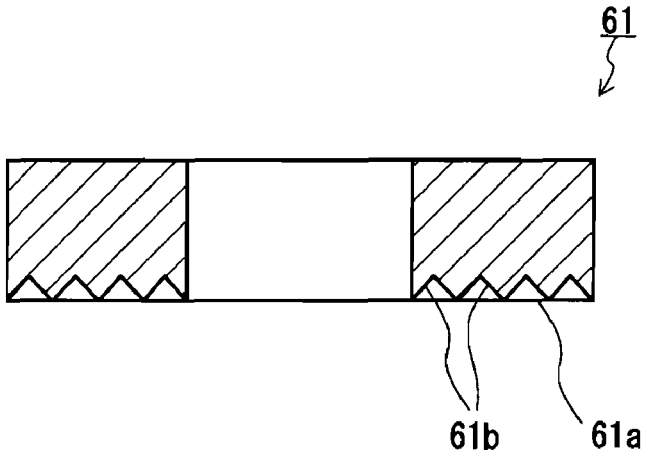
FIG. 13A is a cross-sectional view of a piston with an oil retaining groove formed in a lower face thereof.
Figure 13B:
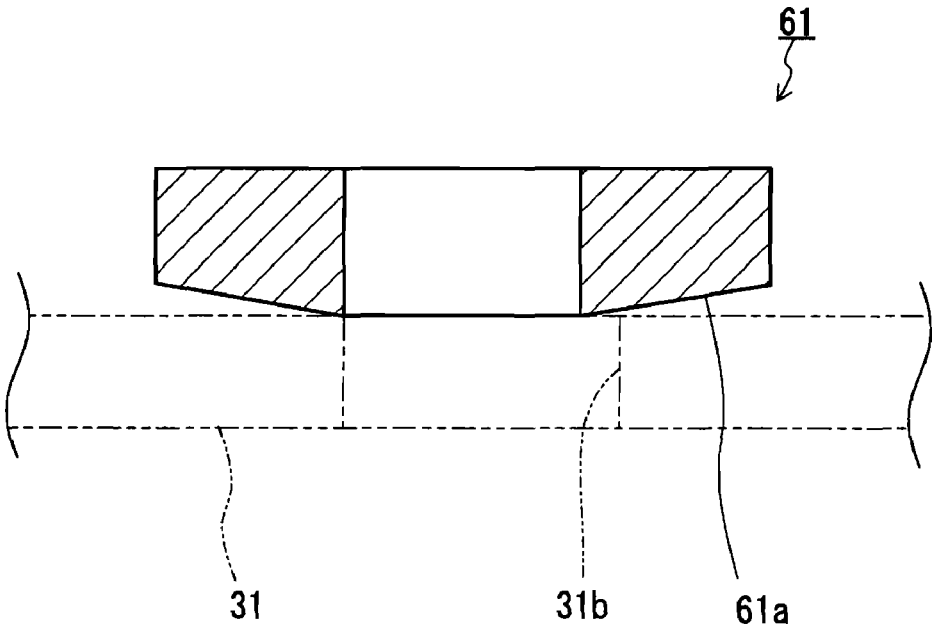
FIG. 13B is a cross-sectional view of a piston with an angled lower face.

Here, a treatment for enhancing the slidability preferably is applied to the lower face 61*a* of the piston 61. The purpose of this is to move the piston 61 smoothly because the lower face 61*a* of the piston 61 is pushed against the upper face of the partition member 31 in the present embodiment. For example, it is conceivable to coat the lower face 61*a* of the piston 61 with a DLC (diamond like carbon) film or a nitride, or apply shot peening to the lower face 61*a* to form minute projections and depressions thereon. Alternatively, as shown in FIG. 13A, a plurality of annular grooves 61*b* may be provided in the lower face 61*a* of the piston 61 to form concentric circles so that the oil is retained in the grooves 61*b*. Or, as shown in FIG. 13B, the lower face 61*a* of the piston 61 may be slightly angled upwardly toward the outside in a radial direction so that the oil is supplied automatically between the lower face 61*a* and the upper face of the partition member 31 as the piston 61 moves.

Still alternatively, the treatment (such as coating and peening) for enhancing the slidability may be applied only to the upper face (a region surrounded by the housing 62) of the partition member 31 on which the lower face 61*a* of the piston 61 slides, or may be applied to both of the lower face 61*a* of the piston 61 and the upper face of the partition member 31.

The present embodiment uses the oil pump 6 in which the housing 62 has the discharge passage 62*b*. However, it also is possible to omit the discharge passage 62*b*. In this case, a part of the working chamber 64 that opens to the groove 73*b* formed in the introduction member 73, in other words, a region in which the groove 73*b* is overlapped with the working chamber 64 when viewed in plane, serves as the discharge port of the oil pump 6.

In the Embodiment 2, the lower end 29*e* of the oil supply passage 29 is located below the inlet 29*p*. However, the effect of suppressing the heat transfer from the compression mechanism to the expansion mechanism via the oil can be obtained even when the lower end 29*e* of the oil supply passage 29 is located at the same height as that of the inlet 29*p*.

More specifically, in the configuration according to the Embodiment 2, the oil pump is disposed between the compression mechanism and the expansion mechanism, and the oil discharged from the oil pump is supplied to the compression mechanism through the oil supply passage formed in the shaft. Therefore, the oil drawn into the oil pump is supplied to the upper-located compression mechanism without passing through the lower-located expansion mechanism, and then is returned to the oil reservoir. By disposing the oil pump between the compression mechanism and the expansion mechanism and supplying the oil to the compression mechanism with the oil pump in this way, it is possible to keep the circulation passage for the oil lubricating the compression mechanism away from the expansion mechanism. In other words, it is possible to avoid having the expansion mechanism located on the circulation passage of the oil lubricating the compression mechanism. Thereby, the heat transfer from the compression mechanism to the expansion mechanism via the oil can be suppressed.

Furthermore, in the configuration according to the Embodiment 2, the oil held in the oil reservoir is discharged upward from the oil pump, and then introduced into the oil supply passage formed in the shaft through the introduction passage located above the oil pump and the inlet. Therefore, the oil discharged from the oil pump is supplied to the compression mechanism without approaching the expansion mechanism. This makes it further unlikely for the heat to be transferred to the expansion mechanism from the oil discharged from the oil pump. As a result, the effect of suppressing the heat transfer via the oil can be enhanced further.

INDUSTRIAL APPLICABILITY

Figure 14:
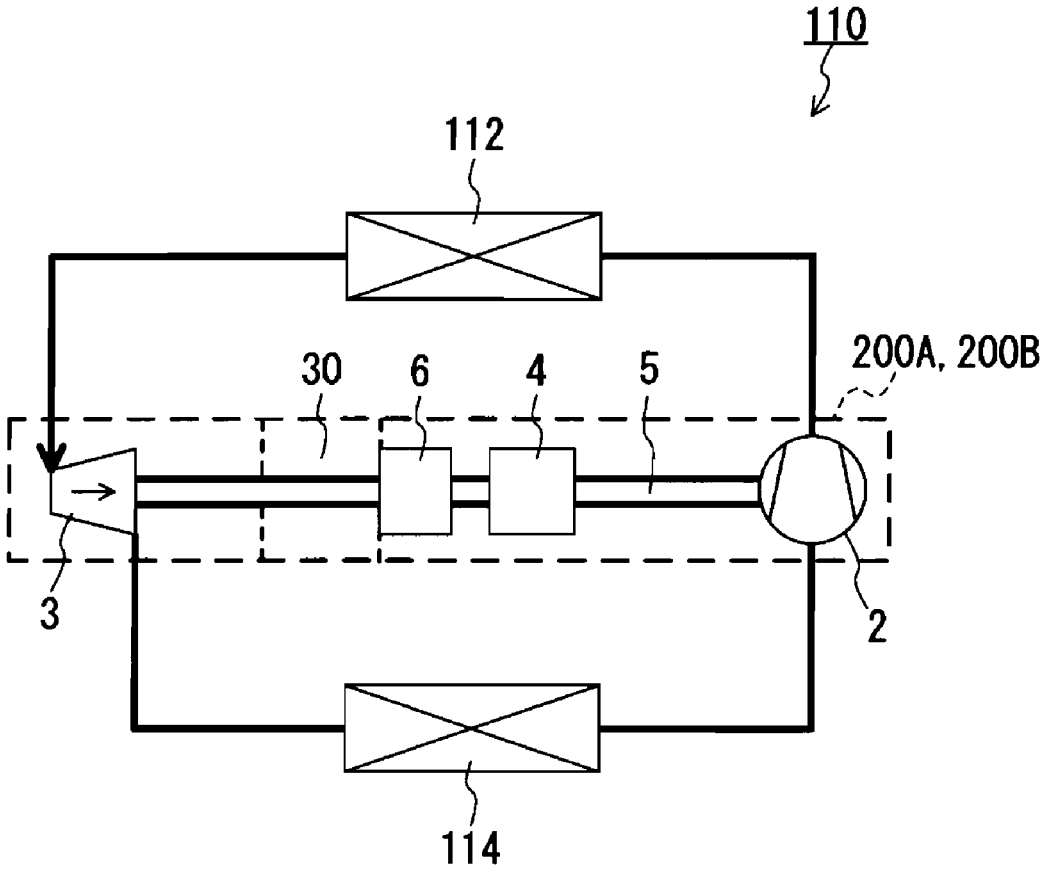
FIG. 14 is a configuration diagram of a refrigeration cycle apparatus using the expander-compressor unit.
Figure 15:
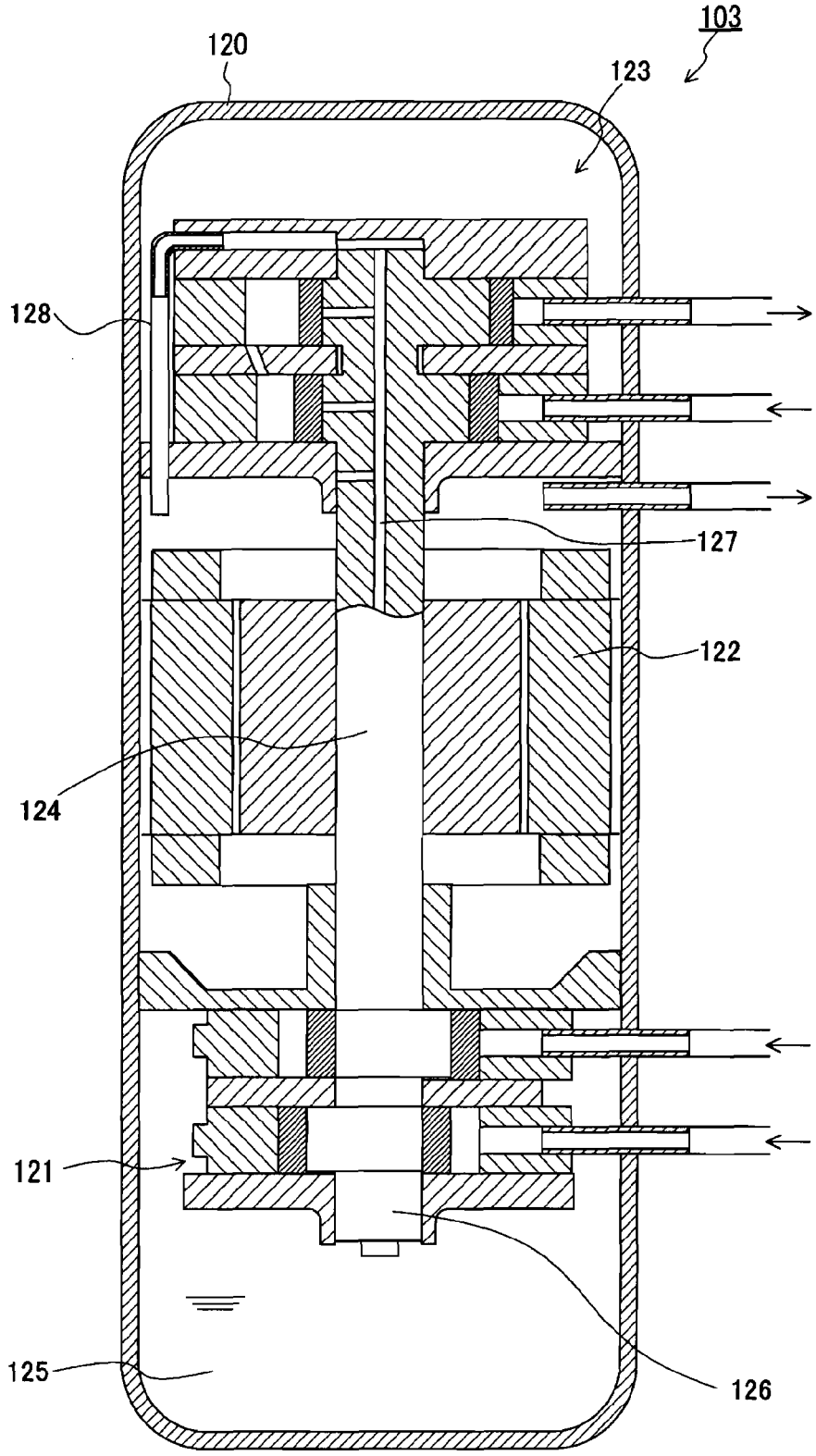
FIG. 15 is a cross-sectional view of a conventional expander-compressor unit.

The expander-compressor unit according to the present invention suitably may be applied to, for example, refrigeration cycle apparatuses (heat pumps) for air conditioners, water heaters, driers, and refrigerator-freezers. As shown in FIG. 14, the refrigeration cycle apparatus 110 includes the expander-compressor unit 200A (or 200B), a radiator 112 for radiating heat from the refrigerant compressed by the compression mechanism 2, and an evaporator 114 for evaporating the refrigerant expanded by the expansion mechanism 3. The compression mechanism 2, the radiator 112, the expansion mechanism 3, and the evaporator 114 are connected with pipes so as to form a refrigerant circuit.

For example, in the case where the refrigeration cycle apparatus 110 is applied to an air conditioner, suppressing the heat transfer from the compression mechanism 2 to the expansion mechanism 3 can prevent a decrease in the heating capacity due to a decrease in the discharge temperature of the compression mechanism 2 during a heating operation and prevent a decrease in the cooling capacity due to an increase in the discharge temperature of the expansion mechanism 3 during a cooling operation. As a result, the coefficient of performance of the air conditioner is increased.

The invention claimed is:

1. An expander-compressor unit comprising:

a closed casing having a bottom portion utilized as an oil reservoir, and an internal space filled with a working fluid that has been compressed and has a high pressure;

a compression mechanism disposed at an upper position in the closed casing, the compression mechanism being configured to compress the working fluid and discharge the working fluid to the internal space of the closed casing;

an expansion mechanism disposed at a lower position in the closed casing so that a surrounding space thereof is filled with an oil held in the oil reservoir, the expansion mechanism being configured to recover power from the working fluid expanding;

a shaft coupling the compression mechanism to the expansion mechanism so that the power recovered by the expansion mechanism is transferred to the compression mechanism;

an oil pump for supplying the oil held in the oil reservoir to the compression mechanism, the oil pump being disposed between the compression mechanism and the expansion mechanism in an axial direction of the shaft; and an oil supply passage formed in the shaft so that the oil discharged from the oil pump can be supplied to the compression mechanism, the oil supply passage having a lower end located below an inlet formed in an outer circumferential surface of the shaft.

2. The expander-compressor unit according to claim 1, wherein the inlet of the oil supply passage is located above a main body of the oil pump, and the oil supply passage includes a portion that is overlapped with the main body of the oil pump along the axial direction.

3. The expander-compressor unit according to claim 1, further comprising a heat insulating structure provided between the oil pump and the expansion mechanism in the axial direction of the shaft, the heat insulating structure being configured to restrict a flow of the oil between an upper tank in which a suction port of the oil pump is located and a lower tank in which the expansion mechanism is located, and thereby suppress heat transfer from the upper tank to the lower tank, wherein the oil supply passage includes a portion overlapped with the heat insulating structure along the axial direction.

4. The expander-compressor unit according to claim 3, wherein the heat insulating structure includes a partition plate separating the upper tank from the lower tank, and a spacer that is disposed between the partition plate and the expansion mechanism and forms, between the partition plate and the expansion mechanism, a space filled by the oil held in the lower tank.

5. The expander-compressor unit according to claim 1, wherein the expansion mechanism has, on a side of the compression mechanism, an upper bearing member for supporting the shaft, and the lower end of the oil supply passage is located above the upper bearing member.

6. The expander-compressor unit according to claim 1, wherein the oil supply passage has a trap, provided below the inlet, for suppressing a flow of the oil.

7. The expander-compressor unit according to claim 1, wherein a heat insulating material is inserted inside the shaft, on a side closer to the expansion mechanism than the lower end of the oil supply passage.

8. The expander-compressor unit according to claim 1, wherein:

the oil pump draws the oil held in the oil reservoir through a suction port and discharges the oil upward through a discharge port;

in the shaft, the inlet of the oil supply passage is provided above the oil pump; and the expander-compressor unit further comprises an introduction passage allowing the discharge port of the oil pump to be communicated, above the oil pump, with the inlet of the oil supply passage.

9. The expander-compressor unit according to claim 8, wherein:

the shaft has an eccentric portion at a position corresponding to the oil pump;

the oil pump has a piston that allows the eccentric portion of the shaft to be fitted thereinto and performs eccentric motion, and a housing accommodating the piston;

the introduction passage faces an upper face of the piston; and the expander-compressor unit further comprises a closing member disposed below the oil pump and adjacent to the housing so that the piston slides on a surface of the closing member.

10. The expander-compressor unit according to claim 9, wherein the eccentric portion of the shaft has a smaller thickness than that of the piston, and is disposed at a lower position inside the piston.

11. The expander-compressor unit according to claim 9, wherein a treatment for enhancing slidability is applied to at least one of a lower face of the piston and an upper face of the closing member on which the lower face of the piston slides.

12. The expander-compressor unit according to claim 9, wherein above the oil pump, an introduction member through which the shaft penetrates is disposed adjacent to the housing, and the introduction member is provided with the introduction passage.

13. The expander-compressor unit according to claim 12, wherein an annular stepped portion obtained by recessing upwardly a circumferential portion of the introduction member surrounding the shaft, and a groove extending outwardly in a radial direction of the shaft from the stepped portion are formed in a lower face of the introduction member, the stepped portion and the groove constitute the introduction passage, and the inlet of the oil supply passage is opened to a space formed by the stepped portion.

14. The expander-compressor unit according to claim 9, wherein the closing member is a partition member that is disposed between the oil pump and the expansion mechanism, partitions the oil reservoir into an upper tank in which the suction port of the oil pump is located and a lower tank in which the expansion mechanism is located, and restricts a flow of the oil between the upper tank and the lower tank.

15. A refrigeration cycle apparatus comprising the expander-compressor unit according to claim 1.

* * * * *